US010544685B2

(12) United States Patent
Takamura et al.

(10) Patent No.: US 10,544,685 B2
(45) Date of Patent: Jan. 28, 2020

(54) TURBINE VANE, TURBINE, AND TURBINE VANE MODIFICATION METHOD

(71) Applicant: MITSUBISHI HITACHI POWER SYSTEMS, LTD., Kanagawa (JP)

(72) Inventors: Keita Takamura, Yokohama (JP); Shunsuke Torii, Yokohama (JP); Masanori Yuri, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 334 days.

(21) Appl. No.: 15/315,471

(22) PCT Filed: Jun. 24, 2015

(86) PCT No.: PCT/JP2015/068228

§ 371 (c)(1),
(2) Date: Dec. 1, 2016

(87) PCT Pub. No.: WO2016/002602

PCT Pub. Date: Jan. 7, 2016

(65) Prior Publication Data

US 2017/0198594 A1 Jul. 13, 2017

(30) Foreign Application Priority Data

Jun. 30, 2014 (JP) ..... 2014-134442

(51) Int. Cl.
*F01D 5/18* (2006.01)
*F01D 9/04* (2006.01)
*F01D 9/06* (2006.01)

(52) U.S. Cl.
CPC ..... *F01D 5/187* (2013.01); *F01D 5/188* (2013.01); *F01D 9/041* (2013.01); *F01D 9/065* (2013.01);

(Continued)

(58) Field of Classification Search
CPC ..... F01D 5/187; F01D 5/188; F01D 9/065; F01D 9/041; F05D 2250/185; F05D 2260/22141; F05D 2240/81
See application file for complete search history.

(56) References Cited

U.S. PATENT DOCUMENTS 4,962,640 A 10/1990 Tobery
5,609,466 A * 3/1997 North ..... F01D 5/187 415/115

(Continued)

FOREIGN PATENT DOCUMENTS

CN 1047905 12/1990
DE 198 10 339 9/1998

(Continued)

OTHER PUBLICATIONS

International Search Report dated Oct. 6, 2015 in corresponding International Application No. PCT/JP2015/068228.

(Continued)

*Primary Examiner* — Peter J Bertheaud
(74) *Attorney, Agent, or Firm* — Wenderoth, Lind & Ponack, L.L.P.

(57) ABSTRACT

A turbine vane (3) includes: a vane body (21); a plate-like inner shroud (22) provided at a radially inner end of the vane body (21); and a plate-like outer shroud (23) provided at a radially outer end of the vane body (21). The vane body (21) includes a serpentine channel (30) which is formed so as to meander inside the vane body (21) in the radial direction and through which a cooling medium flows. The inner shroud (22) includes a cooling path (40) which has one end open at the downstream end side of the serpentine channel (30) and the other end open at a trailing edge (22D) of the inner shroud (22) and through which the serpentine channel (30) communicates with the outside of the inner shroud (22).

6 Claims, 13 Drawing Sheets

(52) U.S. Cl.
CPC .... *F05D 2240/81* (2013.01); *F05D 2250/185* (2013.01); *F05D 2260/20* (2013.01); *F05D 2260/22141* (2013.01)

(56) References Cited

U.S. PATENT DOCUMENTS

| | | | | |
|---|---|---|---|---|
| 6,077,034 | A | 6/2000 | Tomita et al. | |
| 6,089,822 | A * | 7/2000 | Fukuno | F01D 5/189 415/115 |
| 6,099,244 | A | 8/2000 | Tomita et al. | |
| 6,761,529 | B2 * | 7/2004 | Soechting | F01D 5/187 415/115 |
| 8,011,881 | B1 * | 9/2011 | Liang | F01D 5/187 415/115 |
| 8,096,772 | B2 * | 1/2012 | Liang | F01D 11/001 415/115 |
| 8,702,375 | B1 | 4/2014 | Liang | |

FOREIGN PATENT DOCUMENTS

| | | |
|---|---|---|
| DE | 698 20 958 | 10/2004 |
| DE | 698 31 109 | 6/2006 |
| EP | 0 874 131 | 10/1998 |
| JP | 10-252410 | 9/1998 |
| JP | 10-252411 | 9/1998 |
| JP | 10-299409 | 11/1998 |
| JP | 11-132005 | 5/1999 |
| JP | 2005-146858 | 6/2005 |
| JP | 2015-59486 | 3/2015 |

OTHER PUBLICATIONS

Written Opinion of the International Searching Authority dated Oct. 6, 2015 in corresponding International Application No. PCT/JP2015/068228 (with English translation).

* cited by examiner

SECTION X-X

SECTION XI-XI

TURBINE VANE, TURBINE, AND TURBINE VANE MODIFICATION METHOD

TECHNICAL FIELD

The present invention relates to a turbine vane, a turbine including the turbine vane, and a turbine vane modification method.

The present application claims priority based on Japanese Patent Application No. 2014-134442 filed on Jun. 30, 2014, the contents of which are incorporated herein by reference.

BACKGROUND ART

As disclosed in Patent Literature 1, for example, a conventional turbine is provided with turbine vanes that each include a vane body extending in the radial direction of the turbine and plate-like outer shroud and inner shroud provided respectively at both ends of the vane body in the extension direction. Inside the vane body, a serpentine channel meandering in the radial direction of the turbine is provided. The vane body is cooled as a cooling medium (cooling air) flows through the serpentine channel.

In the turbine of Patent Literature 1, a cooling medium having passed through the serpentine channel is guided into a space located farther on the radially inner side of the turbine than the inner shroud, and then flows out into a combustion gas path through a clearance between the inner shroud of the turbine vane and the platform of the turbine blade that are adjacent to each other in the axial direction of the turbine. Thus, combustion gas passing through the combustion gas path is prevented from entering the space located farther on the radially inner side of the turbine than the inner shroud.

The turbine vane of Patent Literature 2 has a serpentine channel formed therein and is provided with a plurality of cooling air holes on the trailing edge side of the inner shroud. The turbine vane of Patent Literature 2 uses a part of cooling air to cool the trailing edge of the inner shroud.

FIG. 13 to FIG. 15 show one example of a structure for cooling the trailing edge side of the inner shroud in a conventional turbine vane. As shown in FIG. 13, cooling air supplied from the outer shroud (not shown) of a turbine vane 3A enters a serpentine channel 30 and cools a vane body 21. Thereafter, the cooling air flows into a most-downstream main channel 31B that is located farthest on the side of a trailing edge end 21B of the vane body 21 in the serpentine channel 30. The cooling air flowing through the most-downstream main channel 31B convectively cools the trailing edge portion of the vane body 21 while being discharged from the trailing edge end 21B of the vane body 21 into combustion gas.

On the other hand, a cavity CB is disposed on the radially inner side of the inner shroud 22, and cooling air is supplied from the outer shroud into the cavity CB. As shown in FIG. 15, a cooling path 70 that has one end, a first end, communicating with the cavity CB and the other end, a second end, open at the downstream end of the inner shroud 22 in the turbine axial direction is formed on the trailing edge side of the inner shroud 22. The cooling path 70 is formed along the direction of combustion gas flow. The plurality of cooling paths 70 are arrayed in the circumferential direction of the inner shroud 22. The array of the plurality of cooling paths 70 mainly cools the trailing edge side of the inner shroud 22.

As shown in FIG. 14, at the downstream end of the most-downstream main channel 31B located on the most downstream side of the serpentine channel 30, the serpentine channel 30 is connected to a terminal channel 31C formed inside the inner shroud 22. An outflow path 29 that provides communication between the terminal channel 31C and a disc cavity CD located on the downstream side from the cavity CB in the turbine axial direction is provided on the downstream side from the terminal channel 31C. The opening of the terminal channel 31C that is open in an upstream-side end face 26*a* of a rib 26 of the inner shroud 22 is closed with a cover 26*b* etc. With the outflow path 29 provided, cooling air flowing inside the inner shroud 22 cools the inner shroud 22 in the vicinity of the terminal channel 31C of the serpentine channel 30, and at the same time is used as a part of purge air for the disc cavity CD.

CITATION LIST

Patent Literatures

Patent Literature 1: Japanese Patent Laid-Open No. 10-252410

Patent Literature 2: Japanese Patent Laid-Open No. 10-252411

SUMMARY OF INVENTION

Technical Problem

However, depending on the structure of the turbine vane, it is not always possible to array the cooling paths in the trailing edge part of the inner shroud evenly in the circumferential direction of the inner shroud. That is, when the inner shroud is seen from the circumferential direction (section XI-XI shown in FIG. 15), one end of the cooling path communicates with the cavity and the other end of the cooling path is open to the combustion gas at the downstream-side end face of the inner shroud. On the other hand, as shown in FIG. 13 and FIG. 14 (section X-X), there is the terminal channel around the joint between the vane body and the inner shroud at the downstream end of the most-downstream main channel. Thus, even if one tries to dispose the above-described cooling path in the region where the terminal channel is present, it is difficult to provide the cooling path due to interference between the terminal channel and the cooling path. Accordingly, it is impossible to dispose the cooling paths at even intervals in the circumferential direction. The result is that the trailing edge part of the inner shroud is cooled unevenly in the circumferential direction of the inner shroud, which may lead to a temperature distribution in the circumferential direction and reduction in thickness due to oxidation in a hot portion of the inner shroud.

Although the temperature of the cooling medium after passing through the above serpentine channel is higher than the temperature before the passage, the temperature is nevertheless low enough to cool the turbine vane.

The present invention provides a turbine vane that can suppress reduction in thickness due to oxidation of a hot portion of the inner shroud resulting from uneven cooling of the trailing edge part of the inner shroud and allows effective use of a cooling medium having passed through the serpentine channel, a turbine including this turbine vane, and a turbine vane modification method.

Solution to Problem

As a first aspect of the present invention to solve the above problem, there is provided a turbine vane including: a vane body extending in the radial direction of a turbine; a plate-like inner shroud provided at a radially inner end of the vane body; and a plate-like outer shroud provided at a radially outer end of the vane body, wherein the vane body includes a serpentine channel which is formed so as to meander inside the vane body in the radial direction and through which a cooling medium flows, and wherein one shroud of the inner shroud and the outer shroud includes a cooling path which has one end open at the downstream end side of the serpentine channel and the other end open at a trailing edge of the one shroud and through which the serpentine channel communicates with the outside of the one shroud.

According to the above turbine vane, the cooling medium flows through the cooling path after flowing through the serpentine channel and cooling the vane body. Thus, it is possible to evenly cool the trailing edge-side part (trailing edge part) of the one shroud and suppress reduction in thickness due to oxidation of the hot portion of the shroud. As the cooling medium having passed through the serpentine channel is recycled, the cooling medium can be used effectively.

A turbine vane as a second aspect of the present invention is the turbine vane according to the first aspect, wherein the one shroud may include a cavity provided on a second principal surface of the one shroud located on the opposite side from a first principal surface on which the vane body is disposed, and wherein a downstream-side end face of the cavity in the axial direction may be disposed farther on the upstream side in the axial direction than a most-downstream main channel of the serpentine channel.

A turbine vane as a third aspect of the present invention is the turbine vane according to the first or second aspect, wherein the cooling path may be formed along the direction of combustion gas flow and provided within an area, in the circumferential direction of the one shroud, where the most-downstream main channel of the serpentine channel is joined to the one shroud.

A turbine vane as a fourth aspect of the present invention is the turbine vane according to any one of the first to third aspects, wherein the cooling path may be formed along the direction of combustion gas flow and provided so as to include, in the circumferential direction of the one shroud, at least a region where a terminal channel constituting the downstream end of the serpentine channel is disposed.

A turbine vane as a fifth aspect of the present invention is the turbine vane according to any one of the first to fourth aspects, wherein the cooling path may include, between one end and the other end thereof, a wide cavity that extends in the circumferential direction of the turbine.

A turbine vane as a sixth aspect of the present invention is the turbine vane according to the fifth aspect, wherein the cooling path may include a plurality of branch paths that are arrayed at intervals in the circumferential direction of the turbine, extend from the wide cavity in the axial direction of the turbine, and are open at the trailing edge of the one shroud.

According to these configurations, the region on the trailing edge side of the one shroud that is cooled with the cooling medium flowing through the cooling path can be expanded in the circumferential direction of the turbine. In other words, the cooling medium having passed through the serpentine channel can be used more effectively.

A turbine vane as a seventh aspect of the present invention is the turbine vane according to any one of the first to sixth aspects, wherein the one shroud may include a second cooling path which has one end open to a cavity that is provided on a second principal surface of the one shroud located on the opposite side from a first principal surface on which the vane body is disposed and the other end open at the trailing edge of the one shroud, and through which a cooling medium inside the cavity passes, and wherein the second cooling path and a first cooling path, which is the cooling path, may be disposed at an interval in the circumferential direction of the turbine.

According to the above configuration, the region of the trailing edge part of the one shroud located in the vicinity of the trailing edge of the vane body can be cooled with the cooling medium passing through the first cooling path as described above. The region of the trailing edge part of the one shroud that is located outside the vicinity of the trailing edge of the vane body in the circumferential direction of the turbine can be cooled with the cooling medium passing through the second cooling path.

Thus, the entire trailing edge part of the one shroud can be cooled efficiently.

A turbine as an eighth aspect of the present invention includes: a rotor; a turbine casing surrounding the periphery of the rotor; turbine blades fixed to the outer circumference of the rotor; and turbine vanes according to any one of the first to seventh aspects that are fixed to the inner circumference of the turbine casing and arrayed alternately with the turbine blades in the axial direction of the rotor.

A turbine vane modification method as a ninth aspect of the present invention is a method of modifying a turbine vane including a vane body extending in the radial direction of a turbine, a plate-like inner shroud provided at a radially inner end of the vane body, and a plate-like outer shroud provided at a radially outer end of the vane body, the vane body including a serpentine channel which is formed so as to meander inside the vane body in the radial direction and through which a cooling medium flows, the method including a path forming step of forming, in one shroud of the inner shroud and the outer shroud, a cooling path which has one end open at the downstream end side of the serpentine channel and the other end open at a trailing edge of the one shroud and through which the serpentine channel communicates with the outside of the one shroud.

Advantageous Effects of Invention

According to the present invention, the temperature distribution in the circumferential direction in the trailing edge part of the one shroud is evened out, and reduction in thickness due to oxidation of the hot portion of the one shroud is suppressed. As the cooling medium having passed through the serpentine channel is recycled, the cooling medium can be used effectively. As a result, the amount of cooling air is reduced and the thermal efficiency of the gas turbine is enhanced.

DESCRIPTION OF EMBODIMENTS (First Embodiment)

In the following, a first embodiment of the present invention will be described with reference to FIGS. 1 to 6.

Figure 1:
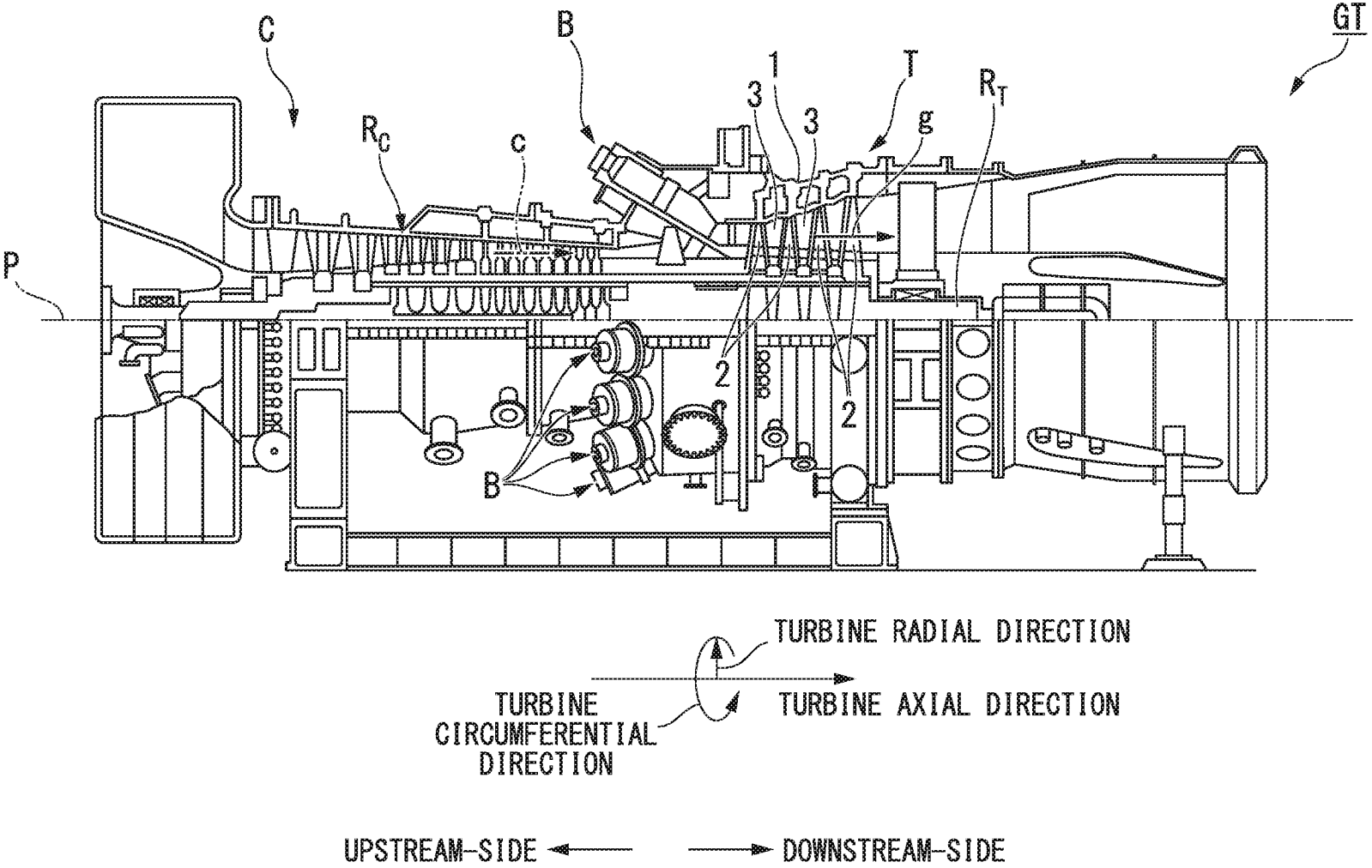
FIG. 1 is a half sectional view showing a schematic configuration of a gas turbine according to a first embodiment of the present invention.

As shown in FIG. 1, a gas turbine GT according to this embodiment includes a compressor C that generates compressed air c, a plurality of combustors B that supply fuel to the compressed air c supplied from the compressor C and generate combustion gas g, and a turbine T that obtains rotational power by the combustion gas g supplied from the combustors 13. In the gas turbine GT, a rotor $R_C$ of the compressor C and a rotor $R_T$ of the turbine T are coupled together at the ends and extend on a turbine axis P.

In the following description, the extension direction of the rotor $R_T$ of the turbine T, the circumferential direction of the rotor $R_T$, and the radial direction of the rotor $R_T$ will be referred to as the turbine axial direction, the turbine circumferential direction, and the turbine radial direction, respectively.

The turbine T includes the rotor $R_T$, a turbine casing 1 surrounding the periphery of the rotor $R_T$, turbine blades 2, and turbine vanes 3. The rotor $R_T$ is composed of a plurality of rotor discs arrayed in the turbine axial direction.

Figure 2:
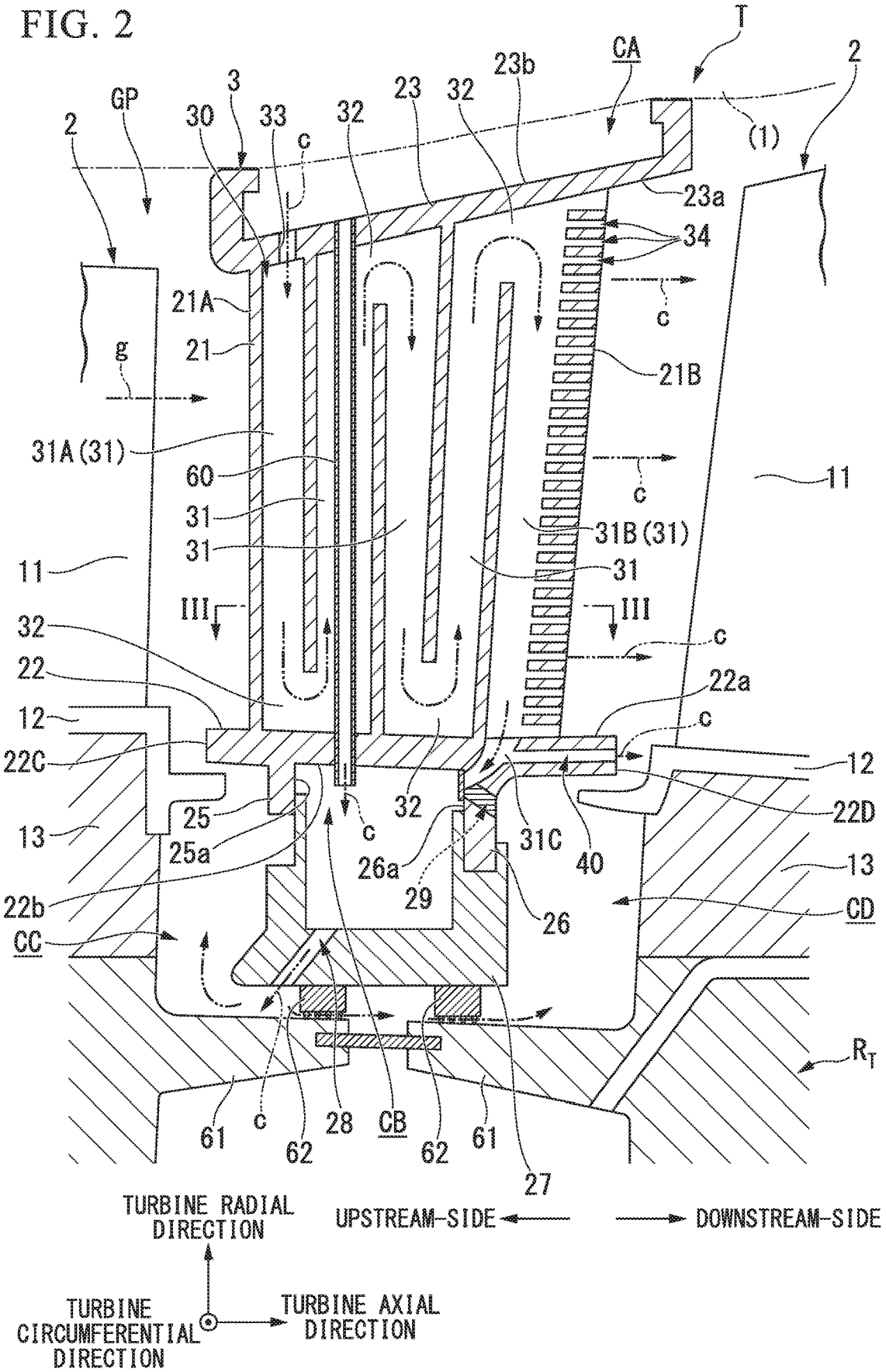
FIG. 2 is a sectional view taken along a mean line Q of a turbine vane according to the first embodiment of the present invention, and corresponds to a sectional view taken along the line II-II of FIG. 3.

As shown in FIG. 1 and FIG. 2, the turbine blades 2 are fixed to the outer circumference of the rotor $R_T$. The plurality of turbine blades 2 are arrayed at intervals in the turbine circumferential direction. The turbine blades 2 constitute an annular blade row. The annular blade rows are arrayed in the turbine axial direction.

The turbine blade 2 is composed of a blade body 11, a platform 12, and a blade root 13 disposed in this order from the outer side toward the inner side in the turbine radial direction. The blade body 11 extends from the outer circumference of the rotor $R_T$ toward the outer side in the turbine radial direction. The platform 12 is provided at the radially inner end of the blade body 11 (base end of the blade body 11) located on the side of the rotor $R_T$ (inner side in the turbine radial direction). Relative to the base end of the blade body 11, the platform 12 extends in the turbine axial direction and the turbine circumferential direction. The blade root 13 is formed continuously from the platform 12 toward the inner side in the turbine radial direction. The blade root 13 is fitted in a blade root groove formed in the outer circumference of the rotor $R_T$ and thereby restrained on the rotor $R_T$.

Figure 3:
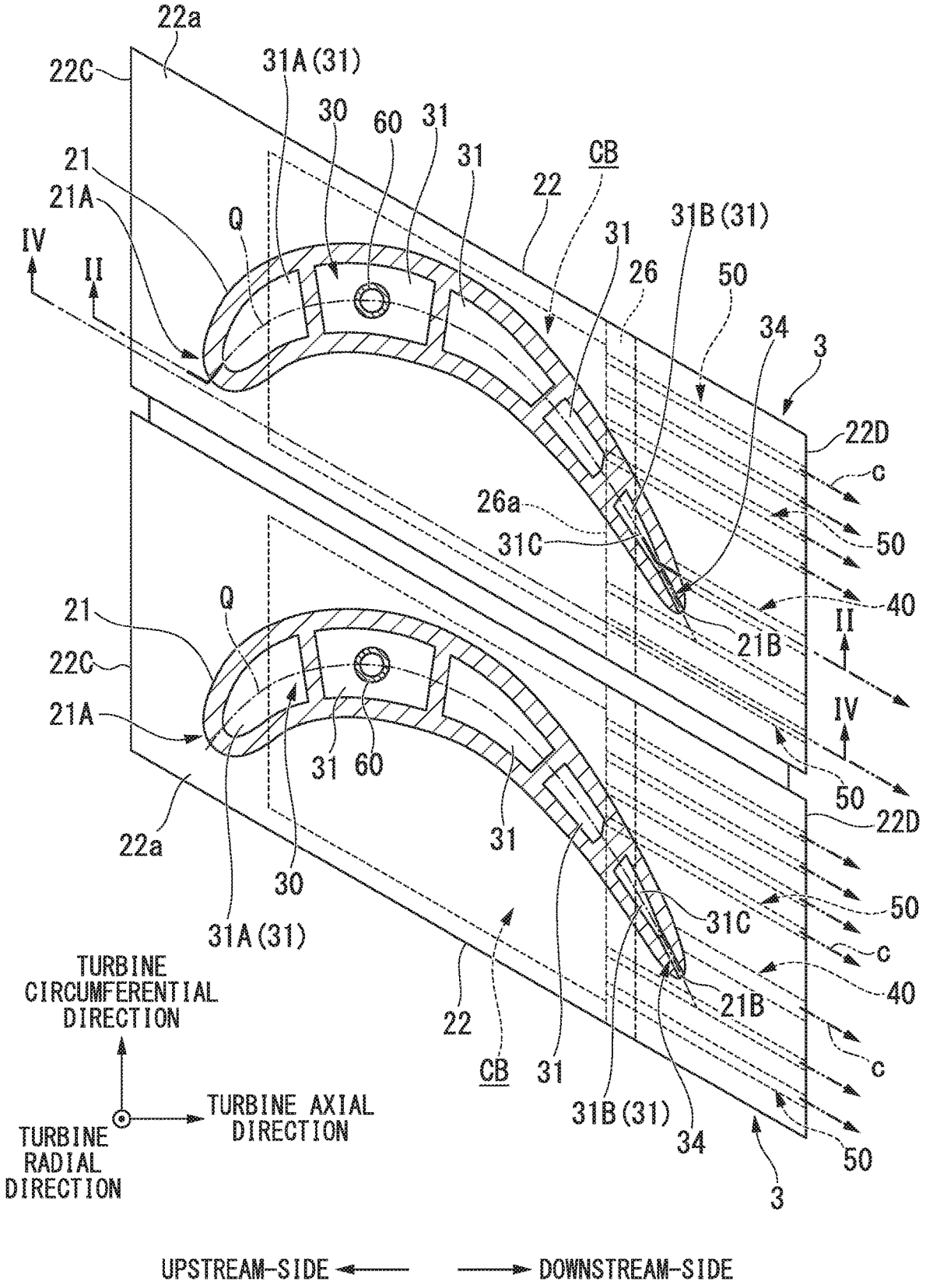
FIG. 3 is a sectional view taken along the line III-III of FIG. 2.

As shown in FIG. 1 to FIG. 3, the turbine vanes 3 are fixed to the inner circumference of the turbine casing 1. The plurality of turbine vanes 3 are arrayed at intervals in the turbine circumferential direction. The turbine vanes 3 constitute an annular vane row. The annular vane rows are arrayed in the turbine axial direction. The vane rows and the above-described blade rows are alternately arrayed in the turbine axial direction. Accordingly, the turbine blades 2 and the turbine vanes 3 are alternately arrayed in the turbine axial direction.

As shown in FIG. 2 and FIG. 3, the turbine vane 3 includes a vane body 21 extending in the turbine radial direction, a plate-like inner shroud 22 provided at the radially inner end of the vane body 21 (leading end of the vane body 21), and a plate-like outer shroud 23 provided at the radially outer end of the vane body 21 (base end of the vane body 21).

The leading end of the vane body 21 is joined to a first principal surface 22*a* of the inner shroud 22 that faces the outer shroud 23. The base end of the vane body 21 is joined to a first principal surface 23*a* of the outer shroud 23 that faces the inner shroud 22.

Relative to the base end of the vane body 21, the outer shroud 23 extends in the turbine axial direction and the turbine circumferential direction. The outer shroud 23 is fixed to the inner circumference of the turbine casing 1. On the side of the first principal surface 23*a* of the outer shroud 23 and on the side of a second principal surface 23*b* thereof located on the radially opposite side, an outer cavity CA into which the compressed air c serving as cooling air (cooling medium) is supplied is formed by the outer shroud 23 and the turbine casing 1.

Relative to the leading end of the vane body 21, the inner shroud 22 extends in the turbine axial direction and the turbine circumferential direction. The inner shroud 22 is disposed between the platforms 12 of two adjacent turbine blades 2 disposed in the turbine axial direction.

Here, the region defined by the inner shrouds 22 and the platforms 12 that are alternately arrayed in the turbine axial direction and the inner circumferences of the outer shrouds 23 facing these inner shrouds 22 and platforms 12 from the radially outer side is a combustion gas path GP through which the combustion gas g flows in the turbine T. In the following description, one side (left side in FIGS. 1 to 3) that is a first end side in the turbine axial direction on which the compressor C and the combustors 13 are disposed relative to the turbine T will be referred to as the upstream side of the combustion gas path GP, while the other side (right side in FIGS. 1 to 3) that is a second end side in the turbine axial direction opposite from the one side in the turbine axial direction will be referred to as the downstream side of the combustion gas path GP.

In the following description, the end of the inner shroud 22 located farther on the upstream side of the combustion gas path GP than a leading edge 21A of the vane body 21 will be referred to as an upstream-side end face (front edge) 22C of the inner shroud 22, while an end of the inner shroud 22 located farther on the downstream side of the combustion gas path GP than a trailing edge end 21B of the vane body 21 will be referred to as a downstream-side end face (trailing edge) 22D of the inner shroud 22.

An inner cavity (cavity) CB into which the compressed air c serving as cooling air (cooling medium) is supplied is provided on the side of a second principal surface 22*b* of the inner shroud 22 located on the radially opposite side from the first principal surface 22*a*. The inner cavity CB is a space surrounded by the inner shroud 22, an upstream-side rib 25 and a downstream-side rib 26 that protrude radially inward from the second principal surface 22*b* of the inner shroud 22 and are disposed at an interval in the turbine axial direction, and a seal ring 27 fixed to the leading ends of the upstream-side rib 25 and the downstream-side rib 26 in the protrusion direction so as to face the second principal surface 22*b* of the inner shroud 22. Thus, the upstream-side end face of the inner cavity CB in the turbine axial direction corresponds to a downstream-side end face 25*a* of the upstream-side rib 25. The downstream-side end face of the inner cavity CB in the turbine axial direction corresponds to an upstream-side end face 26*a* of the downstream-side rib 26.

A disc cavity CC and a disc cavity CD are formed respectively on both sides of the inner cavity CB in the turbine axial direction. The disc cavity CC and the disc cavity CD are spaces surrounded by the blade roots 13 of the turbine blades 2 and the above-described rotor discs facing each other in the turbine axial direction, and the upstream-side rib 25, the downstream-side rib 26, and the seal ring 27 provided on the turbine vane 3. The disc cavity CC and the disc cavity CD communicate with the combustion gas path GP through the clearance between the inner shroud 22 and the platform 12.

The first disc cavity CC located farther on the upstream side of the combustion gas path GP than the inner cavity CB communicates with the inner cavity CB through a flow-through hole 28 formed in the seal ring 27. Accordingly, a part of the compressed air c inside the inner cavity CB is discharged from the inner cavity CB into the first disc cavity CC. The part of the compressed air c having been discharged flows out into the combustion gas path GP through the clearance between the inner shroud 22 and the platform 12 facing the upstream-side end face 22C of the inner shroud 22. Rims 61 that extend from the rotor discs in the turbine axial direction are provided on the radially inner side of the seal ring 27. Disc seal 62 are provided between the rims 61 and the seal ring 27. The compressed air c having leaked from the first disc cavity CC through the disc seal 62 into the second disc cavity CD on the downstream side is similarly discharged into the combustion gas path GP on the downstream side. A part of the compressed air c is discharged into the first disc cavity CC and the second disc cavity CD, and is then discharged as purge air into the combustion gas path GP. Thus, the combustion gas g is prevented from flowing back into the first disc cavity CC and the second disc cavity CD.

The vane body 21 includes a serpentine channel 30 which is formed so as to meander inside the vane body 21 in the turbine radial direction and through which the compressed air c serving as cooling air (cooling medium) flows.

The serpentine channel 30 includes a plurality of (in the shown example, five) main channels 31 formed as a folded channel extending in the turbine radial direction, and a plurality of (in the shown example, four) return channels 32 connecting between adjacent main channels 31.

A most-upstream main channel 31A of the plurality of main channels 31 that is disposed farthest on the side of the leading edge 21A of the vane body 21 communicates with the outer cavity CA through an inflow path 33 that is formed so as to penetrate the outer shroud 23 in the thickness direction. A most-downstream main channel 31B of the plurality of main channels 31 that is disposed farthest on the side of the trailing edge end 21B of the vane body 21 is connected to a terminal channel 31C that extends inside the inner shroud 22 radially inward from the position at which the vane body 21 and the inner shroud 22 are joined together. The terminal channel 31C communicates with the outside of the turbine vane 3 through a first cooling path 40, to be described later, formed inside the inner shroud 22. An outflow path 29 that provides communication between the terminal channel 31C and the second disc cavity CD is formed inside the inner shroud 22 shown in FIG. 2, and the outflow path 29 is closed with a plug etc.

Accordingly, the compressed air c serving as cooling air (cooling medium) flows from the outer cavity CA through the inflow path 33 of the outer shroud 23 into the most-upstream main channel 31A. Thereafter, the compressed air c passes through the serpentine channel 30, and flows from the most-downstream main channel 31B through the terminal channel 31C of the inner shroud 22 into the first cooling path 40. Thus, in this embodiment, the radially outer end of the most-upstream main channel 31A constitutes the upstream end of the serpentine channel 30. In this embodiment, the terminal channel 31C on the radially inner side of the most-downstream main channel 31B constitutes the downstream end of the serpentine channel 30.

The vane body 21 has a plurality of cooling holes 34 that penetrate from the channel wall surface of the most-downstream main channel 31B to the trailing edge end 21B of the vane body 21. The plurality of cooling holes 34 are arrayed at intervals in the turbine radial direction. Accordingly, a part of the compressed air c flowing through the most-downstream main channel 31B flows into the cooling holes 34 and convectively cools the trailing edge part of the vane body 21 before flowing out from the trailing edge end 21B into the combustion gas path GP.

The inner shroud (one shroud) 22 has the first cooling path 40 that has one end open to the terminal channel 31C on the downstream end side of the serpentine channel 30 and the other end open in the downstream-side end face 22D of the inner shroud 22. Through the first cooling path 40, the serpentine channel 30 communicates with the combustion gas path GP (outside of the inner shroud 22). The first cooling path 40 of this embodiment is formed so as to extend from the terminal channel 31C at the downstream end of the serpentine channel 30 of the vane body 21 to the downstream-side end face 22D of the inner shroud 22. The first cooling path 40 of this embodiment is formed along the flow direction of the combustion gas g.

Accordingly, the compressed air c flowing out from the downstream end of the serpentine channel 30 flows into the first cooling path 40 and convectively cools the trailing edge part of the inner shroud 22 before flowing from the downstream-side end face 22D to the outside. Specifically, the compressed air c flows out from the downstream-side end face 22D of the inner shroud 22 into the clearance between the downstream-side end face 22D of the inner shroud 22 and the platform 12 facing the downstream-side end face 22D.

Figure 4:
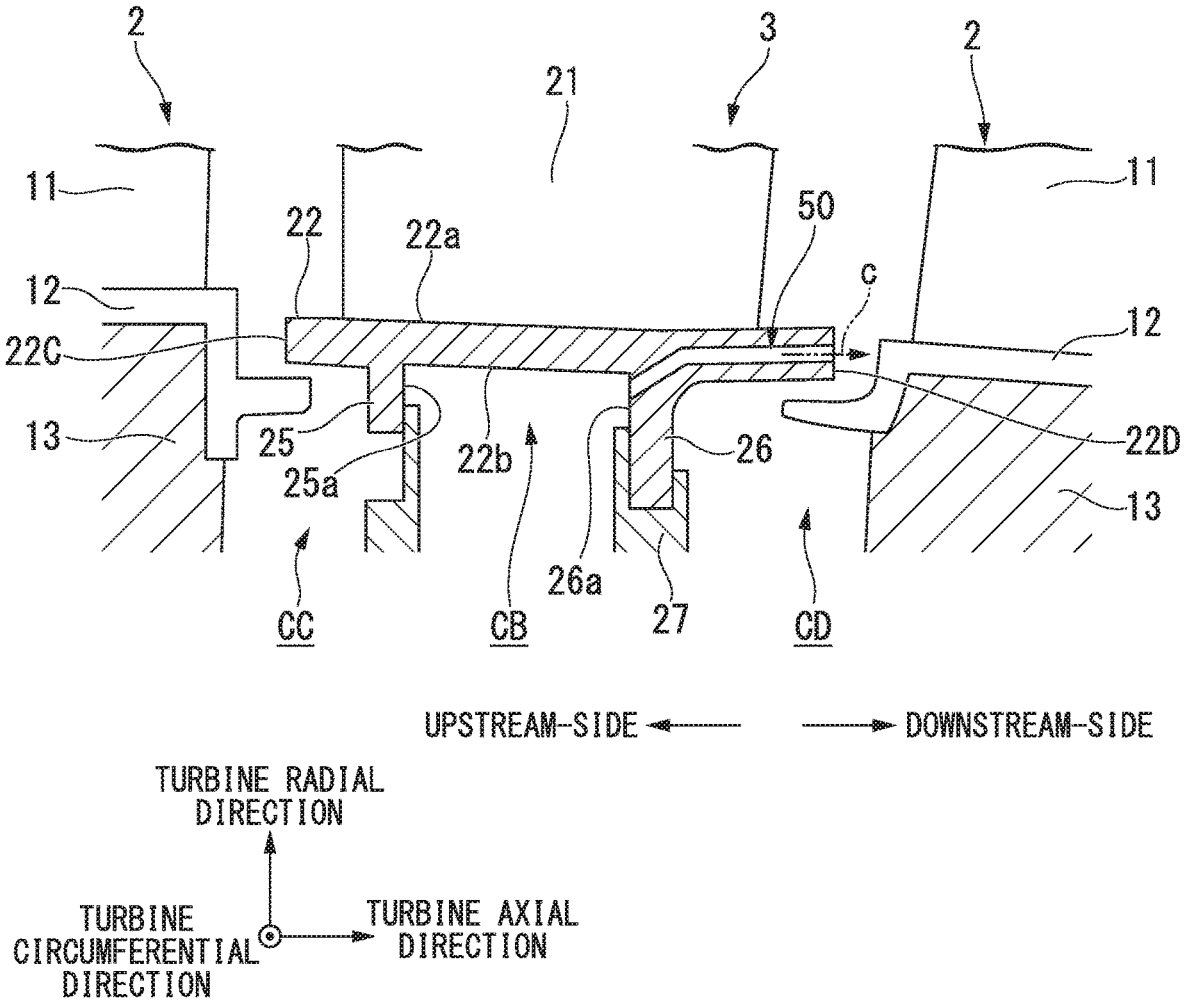
FIG. 4 is a sectional view taken along the line IV-IV of FIG. 3.

As shown in FIG. 3 and FIG. 4, the inner shroud 22 of the turbine vane 3 of this embodiment includes second cooling paths 50 that have one ends open to the inner cavity CB provided on the side of the second principal surface 22*b* of the inner shroud 22 and the other ends open in the downstream-side end face 22D of the inner shroud 22. The second cooling paths 50 are paths through which the compressed air c inside the inner cavity CB flows to cool the trailing edge part of the inner shroud 22. The second cooling paths 50 and the first cooling path 40 are disposed at intervals in the turbine circumferential direction.

In this embodiment, portions of the second cooling paths 50 are also formed in the downstream-side rib 26, which is located on the downstream side of the combustion gas path GP, of the upstream-side rib 25 and the downstream-side rib 26. In addition, the one ends of the second cooling paths 50 are open in the upstream-side end face 26*a* of the downstream-side rib 26 that defines the inner cavity CB. In this embodiment, the plurality of second cooling paths 50 are arrayed at intervals in the turbine circumferential direction. The second cooling paths 50 are disposed on both sides of the first cooling path 40 in the turbine circumferential direction. In FIG. 3, the second cooling paths 50 extend linearly in parallel to the first cooling path 40, but the present invention is not limited to this example.

Accordingly, a part of the compressed air c inside the inner cavity CB flows into the second cooling paths 50 and convectively cools the trailing edge part of the inner shroud 22 before flowing from the downstream-side end face 22D to the outside.

As shown in FIG. 2 and FIG. 3, the turbine vane 3 of this embodiment includes a supply tube 60 through which the compressed air c serving as cooling air (cooling medium) is supplied from the outer cavity CA into the inner cavity CB. The supply tube 60 is provided so as to penetrate the outer shroud 23, the vane body 21, and the inner shroud 22. In the shown example, one supply tube 60 is provided in each vane body 21 so as to pass through the inside of the two adjacent main channels 31 that are disposed farther on the side of the trailing edge end 21B of the main body 21 than the most-upstream main channel 31A, but the present invention is not limited to this example.

Here, an area in which the first cooling path 40 can be disposed will be described.

As described above, in a conventional turbine vane 3A having a serpentine channel, a cooling path 70 for cooling the trailing edge part of the inner shroud 22 cannot be disposed due to interference between the cooling path 70 and the terminal channel 31C of the serpentine channel 30. As a result, there is a region where an uneven temperature distribution occurs in the trailing edge part of the inner shroud 22.

Figure 5:
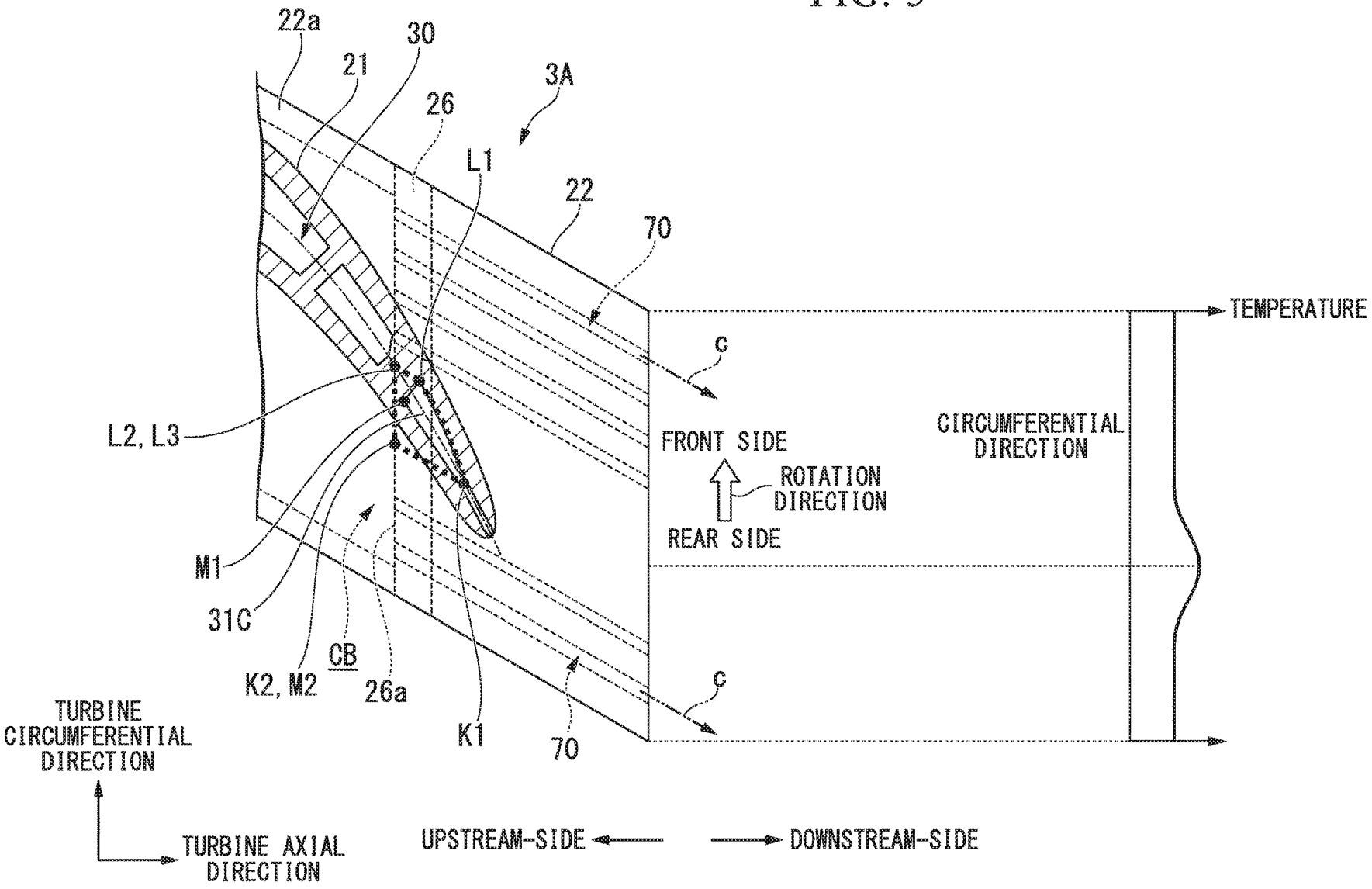
FIG. 5 is a view showing the positional relation between cooling paths in a trailing edge part of an inner shroud and a terminal channel of a serpentine channel in a conventional turbine vane.

The area of the terminal channel 31C formed inside the inner shroud 22 of the conventional turbine vane 3A as shown in FIG. 5 will be described below.

As described above, the upstream side of the terminal channel 31C, which is formed inside the inner shroud 22, is in contact with the downstream end of the most-downstream main channel 31B of the serpentine channel 30. The downstream side of the terminal channel 31C is connected to the opening formed in the upstream-side end face 26*a* of the downstream-side rib 26. Specifically, the upstream end of the terminal channel 31C is represented by a channel section K1L1M1 formed at a position at which the vane body 21 is joined to the first principal surface 22*a* of the inner shroud 22, and has a substantially triangular channel section. Here, a point that is located in the inner wall forming the most-downstream main channel 31B of the serpentine channel 30 and that is closest to the trailing edge end 21B is referred to as a point K1, and points that are located in the leading edge-side inner wall forming the most-downstream main channel 31B and that are farthest on the front side and the rear side in the turbine rotation direction are referred to as a point L1 and a point M1, respectively.

Figure 6:
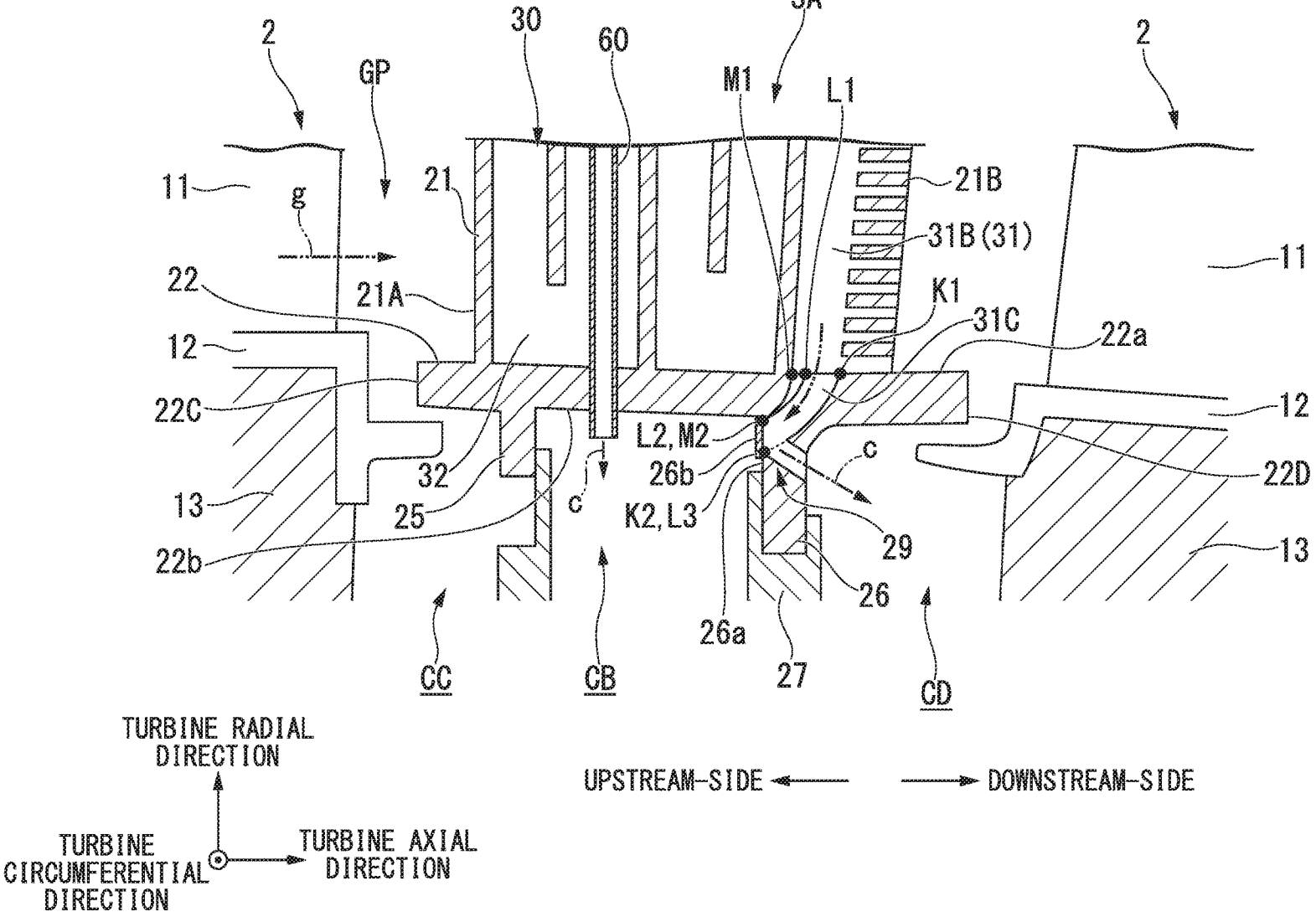
FIG. 6 is a sectional view showing one example of a turbine vane before modification.

As shown in FIG. 5 and FIG. 6, the terminal channel 31C is formed so as to be connected to an opening L2L3K2M2 formed in the upstream-side end face 26*a* of the downstream-side rib 26 while defining an inclined channel toward the opening L2L3K2M2. Thus, the channel section of the terminal channel 31C in the first principal surface 22*a* when seen from the radial direction is a triangular channel section surrounded by the points K1, L1, M1. On the other hand, the channel section of the terminal channel 31C, when the opening L2L3K2M2 formed in the upstream-side end face 26*a* of the downstream-side rib 26 is seen from the axial direction, has a rectangular shape with the upper side (side on the radially outer side) represented by a side L2M2 and the lower side (side on the radially inner side) represented by a side K2L3. That is, a side K1 L1 of the channel section K1L1M1 of the channel formed in the first principal surface 22*a* defines the bottom surface of the terminal channel 31C and is connected to the side K2L3 while extending radially inward and inclining toward the axially upstream side. Similarly, a side L1 M1 of the channel defines the ceiling surface of the terminal channel 31C and is connected to the side L2M2 while extending radially inward and inclining toward the axially upstream side. Thus, the terminal channel 31C is represented by the channel surrounded by a ceiling surface L1M1M2L2, a bottom surface K1L1L3K2, a side surface L1L2L3 on the front side in the rotation direction, and a side surface K1M1M2K2 on the rear side in the rotation direction. As described above, the opening L2L3K2M2 is closed with the cover 26*b*.

[Workings and Effects]

As described above, in the area where the terminal channel 31C is formed, the conventional cooling path 70 that extends from the cavity CB to the downstream end of the inner shroud 22 in the turbine axial direction cannot be disposed due to interference between the cooling path 70 and the terminal channel 31C. Therefore, in the conventional turbine vane 3A, when the temperature distribution in the circumferential direction in the trailing edge part of the inner shroud 22 is depicted as shown in the graph on the right side of FIG. 5, the temperature distribution has a parabolic shape with the temperature higher in the region where the cooling paths 70 are not arrayed (region where the cooling path 70 interferes with the terminal channel 31C) and lower in the other regions. As a result, in the conventional turbine vane 3A, reduction in thickness due to oxidation may occur in the hot portion of the inner shroud 22.

However, it is possible to cool the region where it is difficult to provide the cooling path 70 (second cooling path 50) by providing the first cooling path 40 according to the present invention. Specifically, as shown in FIG. 3, the first cooling path 40 is disposed such that the upstream side is connected to the terminal channel 31C while the downstream side is open to the combustion gas path GP at the downstream-side end face 22D of the inner shroud 22. Thus, the above-described problem of interference does not arise.

As shown in FIG. 2, FIG. 3, and FIG. 5, the first cooling path 40 can be provided, in the circumferential direction of the inner shroud 22, in the region where the terminal channel 31C is disposed when the inner shroud 22 is seen from the radial direction. To look at this in another way, in the circumferential direction of the inner shroud 22, the area occupied by the most-downstream main channel 31B of the serpentine channel 30 at the position at which the vane body 21 is joined to the first principal surface 22*a* of the inner shroud 22 can be said to be the region most effective for the first cooling path 40 to be provided in as a measure against reduction in thickness due to oxidation occurring in the trailing edge part of the inner shroud 22.

Cooling air discharged from the terminal end of the serpentine channel 30 flows through the first cooling path 40. Thus, the cooling air passing through the first cooling path 40 is different from the cooling air flowing through the second cooling paths 50 (cooling paths 70). It is therefore possible to cool the vicinity of the terminal channel 31C of the inner shroud 22 and the region on the downstream side from the terminal channel 31C in the turbine axial direction that are not sufficiently cooled through the second cooling paths (cooling paths 70). Accordingly, the trailing edge part of the inner shroud 22 can be cooled evenly. In other words, it is possible to even out the temperature distribution in the circumferential direction in the trailing edge part of the inner shroud 22 and suppress reduction in thickness due to oxidation of the hot portion of the inner shroud 22.

As the cooling air having cooled the vane body 21 in the serpentine channel 30 is used to cool the above-described region, the cooling air is recycled and thus can be used effectively.

In FIG. 3, there is only one first cooling path 40, but there may be a plurality of first cooling paths 40. It is desirable that the bore diameter (channel section) of the first cooling path 40 be larger than that of the second cooling path 50. This is because it is desirable to allow a larger amount of cooling air to flow through the first cooling path 40 and enhance the cooling efficiency, for the temperature of the cooling air discharged from the serpentine channel 30 is higher than that of the cooling air flowing through the second cooling paths 50.

The first cooling path 40 is not limited to being provided as illustrated in FIG. 3 when the inner shroud 22 is seen from the radial direction, but can be provided so as to include, in the circumferential direction of the inner shroud 22, at least the region where the terminal channel 31C is disposed. For example, the first cooling path 40 may be provided so as to project in the turbine circumferential direction from the region where the terminal channel 31C is disposed in the circumferential direction of the inner shroud 22.

The first cooling path 40 is not limited to being provided as illustrated in FIG. 3 when the inner shroud 22 is seen from the radial direction, but can be provided so as to include, in the circumferential direction of the inner shroud 22, at least the area occupied by the most-downstream main channel 31B of the serpentine channel 30 at the position at which the vane body 21 and the first principal surface 22*a* of the inner shroud 22 are joined together. For example, the first cooling path 40 may be provided so as to project in the turbine circumferential direction from the area occupied by the most-downstream main channel 31B in the circumferential direction of the inner shroud 22.

As shown in FIG. 6, the turbine vane 3 of the gas turbine GT configured as has been described above can be obtained by modifying the conventional turbine vane 3A that does not include the first cooling path 40.

In the conventional turbine vane 3A, the outflow path 29 is formed that provides communication between the terminal channel 31C at the downstream end of the serpentine channel 30 and the space on the radially inner side of the inner shroud 22. In FIG. 6, the outflow path 29 provides communication between the downstream end of the serpentine channel 30 and the second disc cavity CD located farther on the downstream side of the combustion gas path GP than the inner cavity CB. In FIG. 6, the outflow path 29 is formed in the downstream-side rib 26, but the outflow path 29 may instead be formed in the inner shroud 22, for example.

Accordingly, in the conventional turbine vane 3A, the compressed air c having flowed out from the downstream end of the serpentine channel 30 is discharged through the outflow path 29 into the second disc cavity CD, and flows out into the combustion gas path GP through the clearance between the inner shroud 22 and the platform 12 facing the downstream-side end face 22D of the inner shroud 22. Thus, the compressed air c discharged through the outflow path 29 into the second disc cavity CD is used as purge gas along with the compressed air c (see FIG. 2) leaking out of the disc seal 62, and prevents the combustion gas g passing through the combustion gas path GP from entering the second disc cavity CD through the clearance between the inner shroud 22 and the platform 12.

In a turbine vane modification method for obtaining the turbine vane 3 of this embodiment from the conventional turbine vane 3A described above, as shown in FIG. 7*a*, a path forming step S1 of forming, inside the inner shroud 22, the first cooling path 40 which has one end open to the terminal channel 31C at the downstream end of the serpentine channel 30 and the other end open in the downstream-side end face 22D of the inner shroud 22 and through which the serpentine channel 30 communicates with the outside of the inner shroud 22 should be performed.

Figure 7:
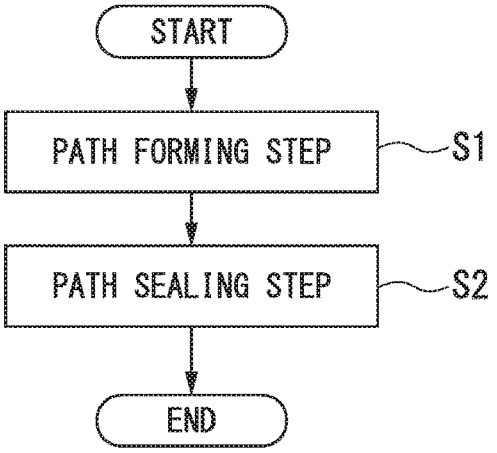
FIG. 7 is a flowchart showing a turbine vane modification method according to the first embodiment of the present invention.

To modify the conventional turbine vane 3A illustrated in FIG. 6 that has the outflow path 29, a path sealing step S2 of sealing the outflow path 29 should be performed after the path forming step S1 as shown in FIG. 7, or before the path forming step S1. In the path sealing step S2, for example, the outflow path 29 should be closed with a plug etc.

Next, the workings of the turbine vane 3 of the gas turbine GT of this embodiment will be described.

The compressed air c cools the vane body 21 by flowing from the outer cavity CA through the inflow path 33 into the serpentine channel 30 and flowing from the upstream end toward the downstream end of the serpentine channel 30. A part of the compressed air flowing through the most-downstream main channel 31B of the serpentine channel 30 is discharged into the cooling holes 34 and flows out from the trailing edge end 21B of the vane body 21 into the combustion gas path GP. As a result, the compressed air c cools the portion of the vane body 21 on the side of the trailing edge end 21B.

The compressed air c having flowed out from the terminal channel 31C of the serpentine channel 30 flows into the first cooling path 40 and flows out from the downstream-side end face 22D of the inner shroud 22 into the clearance between the inner shroud 22 and the platform 12.

Thus, the portion of the inner shroud 22 on the side of the downstream-side end face 22D (trailing edge part), particularly the region of the trailing edge part of the inner shroud 22 that stretches to the downstream-side end face 22D from and including the position at which the most-downstream main channel 31B of the serpentine channel 30 and the first principal surface 22*a* of the inner shroud 22 are joined together, the region that is not sufficiently cooled in the conventional turbine vane. As the compressed air c flows out from the first cooling path 40 into the clearance between the inner shroud 22 and the platform 12, this compressed air c, along with the compressed air c leaking from the disc seal 62, prevents the combustion gas g passing through the combustion gas GP from entering the second disc cavity CD through the clearance between the inner shroud 22 and the platform 12.

The compressed air c inside the outer cavity CA flows into the inner cavity CB as well through the supply tube 60. The compressed air c having flowed into the inner cavity CB flows into the first disc cavity CC mainly through the flow-through hole 28 of the seal ring 27. Thereafter, the compressed air c flows out into the combustion gas path GP through the clearance between the inner shroud 22 and the platform 12 facing the upstream-side end face 22C of the inner shroud 22. Thus, the combustion gas g passing through the combustion gas path GP is prevented from entering the first disc cavity CC through the clearance between the inner shroud 22 and the platform 12.

A part of the compressed air c having flowed into the inner cavity CB flows into the second cooling paths 50 and flows out from the downstream-side end face 22D of the inner shroud 22 into the clearance between the inner shroud 22 and the platform 12. Thus, the trailing edge part of the inner shroud 22, particularly the region of the trailing edge part of the inner shroud 22 located outside the vicinity of the trailing edge end 21B of the vane body 21 (vicinity of the first cooling path 40) in the turbine circumferential direction is cooled. As the compressed air c flows out from the second cooling paths 50 into the clearance between the inner shroud 22 and the platform 12, the combustion gas g passing through the combustion gas path GP is more favorably prevented from entering the second disc cavity CD through the clearance between the inner shroud 22 and the platform 12.

As has been described above, according to the turbine vane 3 of the gas turbine GT of this embodiment, the compressed air c flows through the first cooling path 40 after flowing through the serpentine channel 30 and cooling the vane body 21, so that the trailing edge part of the inner shroud 22, particularly the region stretching to the downstream-side end face 22D from the position at which the most-downstream main channel 31B and the first principal surface 22*a* of the inner shroud 22 are joined together, can be cooled. Thus, as the compressed air c having passed through the serpentine channel 30 is used effectively, the cooling air can be recycled and the amount of cooling air can be reduced. As a result, the thermal efficiency of the gas turbine GT is enhanced.

According to the turbine vane 3 of this embodiment, the region of the trailing edge part of the inner shroud 22 in the vicinity of the trailing edge end 21B of the vane body 21 is cooled with the compressed air c flowing through the first cooling path 40. As a result, the region of the trailing edge part of the inner shroud 22 located outside the vicinity of the trailing edge end 21B of the vane body 21 (vicinity of the first cooling path 40) in the turbine circumferential direction can be cooled with the compressed air c flowing through the second cooling paths 50. It is therefore possible to efficiently cool the entire trailing edge part of the inner shroud 22. Thus, it is possible to evenly cool the trailing edge part of the inner shroud 22 and suppress reduction in thickness due to oxidation of the hot portion of the inner shroud 22.

According to the turbine vane 3 of this embodiment, a portion of the trailing edge part of the inner shroud 22 is cooled with the compressed air c (cooling air) having passed through the serpentine channel 30. Accordingly, compared with when the entire trailing edge part of the inner shroud 22 is cooled with the compressed air c flowing through the second cooling paths 50, the amount of compressed air c passing through the second cooling paths 50 can be reduced. In other words, the amount of compressed air c required to cool the trailing edge part of the inner shroud 22 can be reduced. Thus, the efficiency of the turbine T can be enhanced.

(Second Embodiment)

Next, a second embodiment of the present invention will be described with reference to FIG. 8, mainly in terms of differences from the first embodiment. The same components as in the first embodiment will be denoted by the same reference signs while the description thereof will be omitted.

Figure 8:
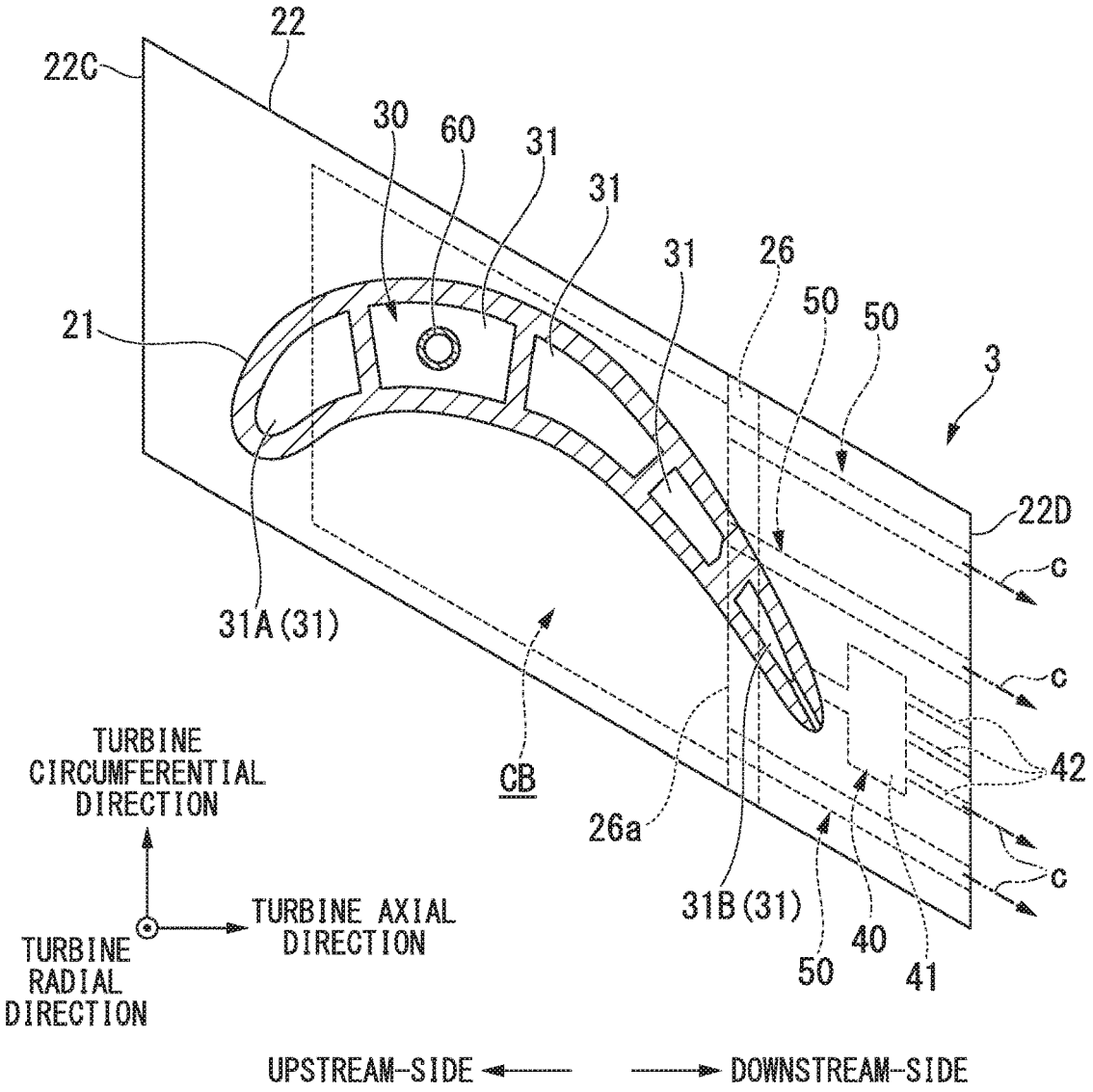
FIG. 8 is a sectional view, taken along the turbine circumferential direction, of a turbine vane according to a second embodiment of the present invention.

As shown in FIG. 8, the turbine 3 of this embodiment includes the same vane body 21 and inner shroud 22 as in the first embodiment. The vane body 21 includes the same serpentine channel 30 as in the first embodiment. As in the first embodiment, the inner shroud 22 includes the first cooling path 40 that has one end open at the downstream end side of the serpentine channel 30 and the other end open in the downstream-side end face 22D of the inner shroud 22.

The first cooling path 40 of this embodiment includes, between one end and the other end thereof, a wide cavity 41 that extends in the turbine circumferential direction. The first cooling path 40 includes a plurality of branch paths 42 that extend from the wide cavity 41 in the turbine axial direction and are open in the downstream-side end face 22D of the inner shroud 22. The plurality of branch paths 42 are arrayed at intervals in the turbine circumferential direction. The dimension of the branch path 42 in the turbine circumferential direction is set to be sufficiently smaller than that of the wide cavity 41. The dimension of the wide cavity 41 in the turbine axial direction may be smaller than that of the branch path 42 as shown in FIG. 8, but may instead be set to be larger than that of the branch path 42, for example.

Accordingly, the compressed air c having flowed out from the downstream end of the serpentine channel 30 flows into the wide cavity 41 of the first cooling path 40, and flows further from the wide cavity 41 into the branch paths 42 before flowing from the downstream-side end face 22D of the inner shroud 22 to the outside.

According to the turbine vane 3 of this embodiment configured as has been described above, effects similar to those of the first embodiment can be achieved.

According to the turbine vane 3 of this embodiment, the region of the trailing edge part of the inner shroud 22 cooled with the compressed air c flowing through the first cooling path 40 can be expanded in the turbine circumferential direction. Thus, the compressed air c having passed through the serpentine channel 30 can be used more effectively.

Compared with the first embodiment, the amount of compressed air c passing through the second cooling paths 50 can be further reduced, and the efficiency of the turbine T can be further enhanced.

(First Modified Example of Second Embodiment)

Next, a first modified example of the second embodiment will be described with reference to FIG. 9, mainly in terms of differences from the second embodiment. The components that are the same as in the first embodiment and the second embodiment will be denoted by the same reference signs while the description thereof will be omitted.

Figure 9:
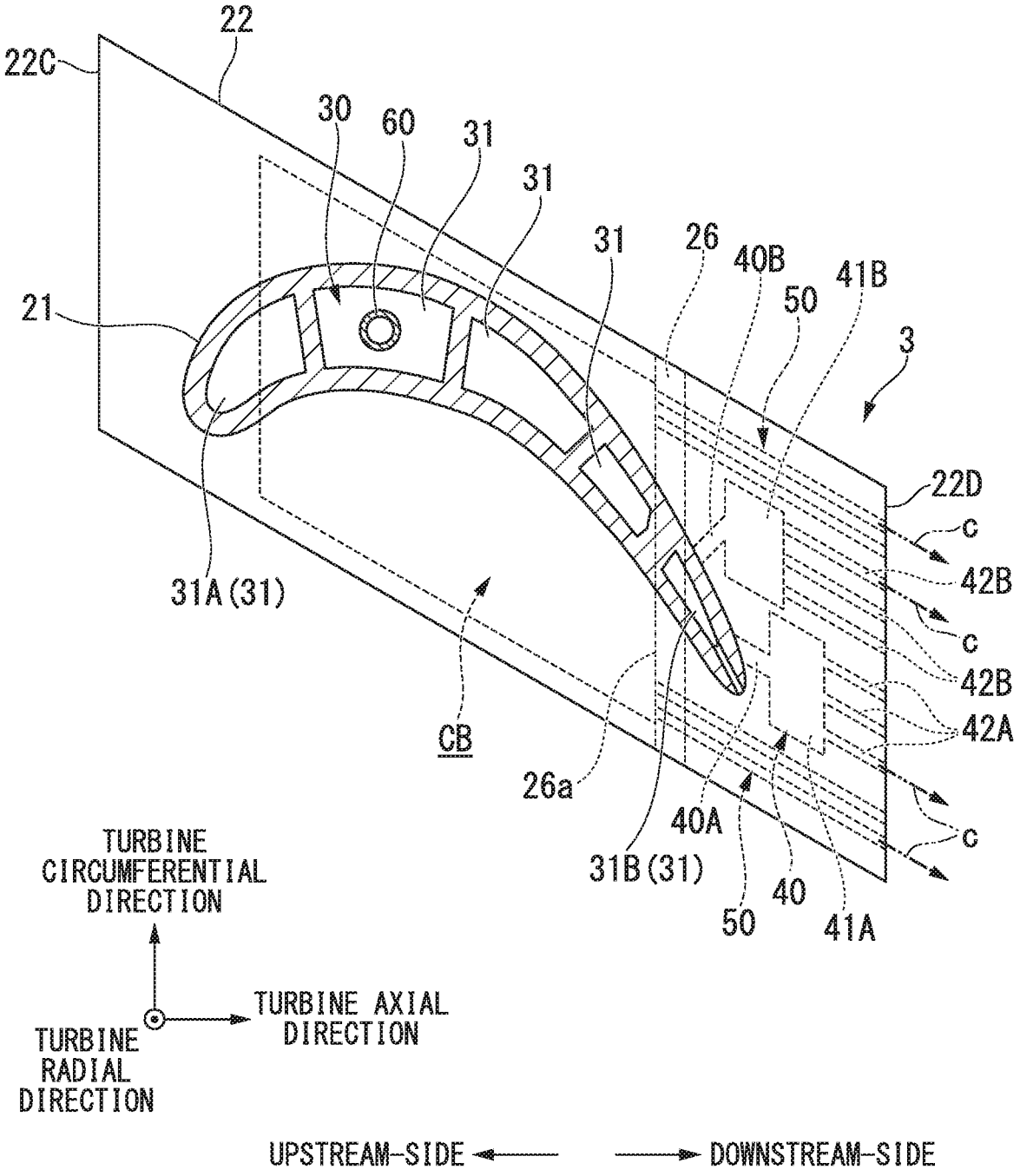
FIG. 9 is a sectional view, taken along the turbine circumferential direction, of a turbine vane according to a first modified example of the second embodiment of the present invention.

As shown in FIG. 9, the first cooling path 40 of the first modified example of the second embodiment is the same as that of the second embodiment in that one end, which is the upstream end of the upstream path, is connected to the terminal channel 31C while the other end is open in the downstream-side end face 22D of the inner shroud 22, and in that the wide cavity is provided at an intermediate position between the one end and the other end. However, the first cooling path 40 of the first modified example is different from that of the second embodiment in that a plurality of upstream paths, i.e., an upstream path 40A and an upstream path 40B, are branched from the terminal channel 31C. Thus, in this modified example, the plurality of upstream paths 40A, 40B are branched from the terminal channel 31C. The upstream path 40A and the upstream path 40B are connected to a wide cavity 41A and a wide cavity 41B, respectively. Pluralities of branch paths 42A and branch paths 42B are branched from the wide cavity 41A and the wide cavity 41B, respectively. The branch paths 42A and the branch paths 42B are open to the combustion gas path GP at the downstream-side end face 22D of the inner shroud 22. The rest of the configuration and the method of modification into the turbine vane of this modified example are the same as in the first embodiment and the second embodiment.

According to the turbine vane 3 of this modified example configured as has been described above, effects similar to those of the first embodiment and the second embodiment can be achieved.

According to the turbine vane of this modified example, compared with the second embodiment, the region of the trailing edge part of the inner shroud 22 cooled with the compressed air c flowing through the first cooling path 40 can be further expanded. Thus, the compressed air c having passed through the serpentine channel 30 can be used even more effectively.

(Second Modified Example of Second Embodiment)

Next, a second modified example of the second embodiment will be described with reference to FIG. 10, mainly in terms of differences from the second embodiment and the first modified example of the second embodiment. The components that are the same as in the first embodiment, the second embodiment, and the first modified example of the second embodiment will be denoted by the same reference signs while the description thereof will be omitted.

Figure 10:
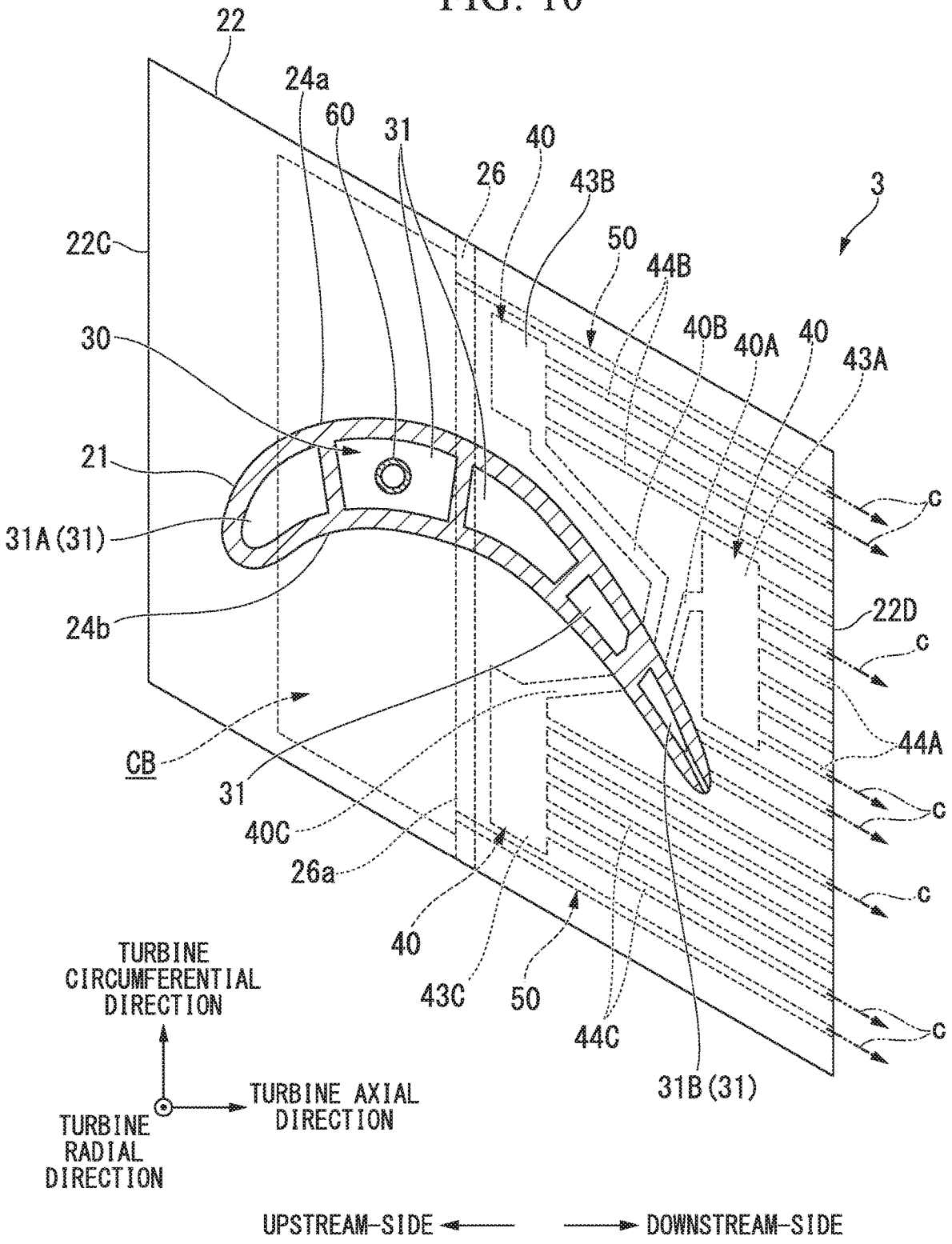
FIG. 10 is a sectional view, taken along the turbine circumferential direction, of a turbine vane according to a second modified example of the second embodiment of the present invention.

As shown in FIG. 10, the second modified example of the second embodiment is the same as the second embodiment and the first modified example of the second embodiment in that the first cooling path 40 has one end, which is the upstream end of the upstream path, connected to the terminal channel 31C and the other end open in the downstream-side end face 22D of the inner shroud 22, and in that the wide cavity is provided at an intermediate position between the one end and the other end. The second modified example is the same as the first modified example of the second embodiment in that a plurality of cooling paths 40 with a wide cavity are provided. However, compared with the first embodiment, the second embodiment, and the first modified example of the second embodiment, the inner cavity CB disposed on the radially inner side of the inner shroud 22 is shifted toward the axially upstream side, and the position of the downstream-side rib 26 is moved toward the axially upstream side. Thus, the second modified example is different in that the downstream-side rib 26 is disposed at an intermediate position in the axial length of the inner shroud 22, or disposed farther on the upstream side than the intermediate position in the axial direction, so as to reduce the axial length of the inner cavity CB.

If such a structure is adopted, the area of the inner shroud 22 cooled with the compressed air c (cooling air) discharged from the downstream end of the serpentine channel 30 can be expanded. In this modified example, the region where the first cooling path 40 is disposed is expanded and the region where the second cooling paths 50 are disposed is reduced, and thereby the region where the compressed air c (cooling air) discharged from the downstream end of the serpentine channel 30 can be effectively used is expanded. Specifically, the first cooling path 40 connected to the terminal channel 31C is branched into a plurality of upstream paths 40A, 40B, 40C. The upstream paths 40A, 40B, 40C are provided with wide cavities 43A, 43B, 43C, respectively. Branch paths 44A, 44B, 44C are disposed on the downstream side from the wide cavities 43A, 43B, 43C, respectively. As in the second embodiment, the upstream path 40A is mainly intended to cool the trailing edge part of the inner shroud 22. On the other hand, the wide cavity 43B and the wide cavity 43C of the upstream path 40B and the upstream path 40C are disposed at positions on the axially downstream side from the downstream-side rib 26, as close to the downstream-side rib 26 as possible. Specifically, the wide cavity 43B is disposed on the side of a suction surface 24*a* (vane surface having a convex shape in a radial sectional view of the vane body) in the circumferential direction of the inner shroud 22. The wide cavity 43C is disposed on the side of a pressure surface 24*b* (vane surface having a concave shape in a radial sectional view of the vane body) in the circumferential direction of the inner shroud 22. Pluralities of branch paths 44B and branch paths 44C extending long from the wide cavity 43B and the wide cavity 43C, respectively, toward the axially downstream side are disposed. The branch paths 44B and the branch paths 44C communicate with the combustion gas path GP at the downstream-side end face 22D of the inner shroud 22. The upstream path 40B and the upstream path 40C are formed as channels that are branched from the terminal channel 31C and extend inside the inner shroud 22 temporarily toward the axially upstream side along the suction surface 24*a* and the pressure surface 24*b* of the vane body 21. The upstream path 40B and the upstream path 40C are connected to the wide cavities 43B, 43C. In this modified example, the first cooling paths 40 including the wide cavity 43B and the wide cavity 43C may be combined with the first cooling path 40 that, as in the first embodiment does not include the wide cavity and has one end connected to the terminal channel 31C and the other end open in the downstream-side end face 22D of the inner shroud 22. The second cooling paths 50 are disposed in the axial direction along both ends of the inner shroud 22 in the circumferential direction (ends on the front side and the rear side in the rotation direction). The second cooling paths 50 have one ends open to the inner cavity CB and the other ends open in the downstream-side end face 22D of the inner shroud 22. Only in the case where the second cooling paths 50 are disposed along the axial direction at both ends of the inner shroud 22 in the circumferential direction, the second cooling paths 50 may be omitted. The rest of the configuration and the method of modification into the turbine vane of this modified example are the same as in the first embodiment, the second embodiment, and the first modified example of the second embodiment.

According to the turbine vane 3 of this modified example configured as has been described above, effects similar to those of the first embodiment and the second embodiment can be achieved.

According to the turbine vane of this modified example, compared with the first modified example of the second embodiment, the region of the trailing edge part of the inner shroud 22 cooled with the compressed air c flowing through the first cooling path 40 is further expanded, and the region where the second cooling paths 50 are disposed is further reduced. Thus, the cooling air can be used even more effectively, as the amount of compressed air discharged from the inner cavity CB through the second cooling paths 50 into the combustion gas g is reduced and the amount of compressed air having passed through the serpentine channel 30 is increased.

(Third Modified Example of Second Embodiment)

Next, a third modified example of the second embodiment will be described with reference to FIG. 11 and FIG. 12, mainly in terms of differences from the second modified example of the second embodiment. The components that are the same as in the first embodiment, the second embodiment, the first modified example of the second embodiment, and the second modified example of the second embodiment will be denoted by the same reference signs while the description thereof will be omitted.

Figure 11:
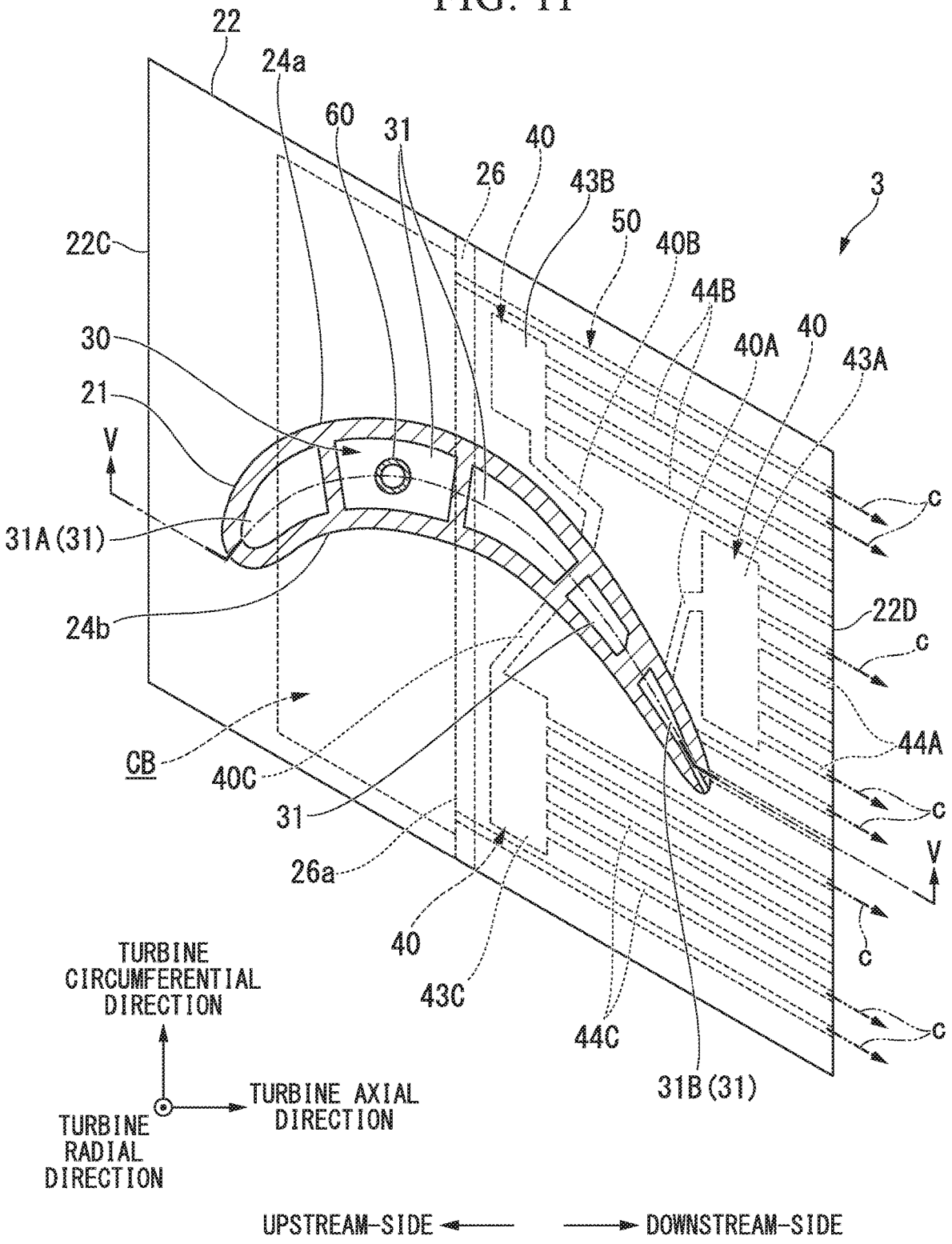
FIG. 11 is a sectional view, taken along the turbine circumferential direction, of a turbine vane according to a third modified example of the second embodiment of the present invention.

As shown in FIG. 11, the third modified example of the second embodiment is different from the second modified example in that the compressed air c that is supplied to the wide cavity 43B and the wide cavity 43C disposed on the side of the suction surface 24*a* and the side of the pressure surface 24*b* of the inner shroud 22 is supplied from a supply source different from a supply source for the wide cavity 43A. Specifically, the supply source of the compressed air c supplied to the wide cavity 43A is the compressed air c that flows into the terminal channel 31C after having cooled the vane body 21 while passing through the serpentine channel 30. On the other hand, the supply source of the compressed air c supplied to the wide cavity 43B and the wide cavity 43C is the compressed air c that is taken out from the return channel 32 located farther on the upstream side of the serpentine channel 30 than the most-downstream main channel 31B. The rest of the configuration is basically the same as in the second modified example.

As shown in FIG. 11, the upstream path 40B is connected to the wide cavity 43B that constitutes a part of the first cooling path 40 disposed on the side of the suction surface 24*a*. The upstream path 40B is connected to an opening 32P (FIG. 12) formed in the return channel 32 that is formed on the side of the inner shroud 22 farther on the upstream side of the serpentine channel 30 than the most-downstream main channel 31B. The upstream path 40C is connected to the wide cavity 43C that constitutes a part of the first cooling path 40 disposed on the side of the pressure surface 24*b*. As with the upstream path 40B, the upstream path 40C is connected to an opening (not shown) formed in the return path 32 that is formed on the side of the inner shroud 22 farther on the upstream side of the serpentine channel 30 than the most-downstream main channel 31B.

Figure 12:
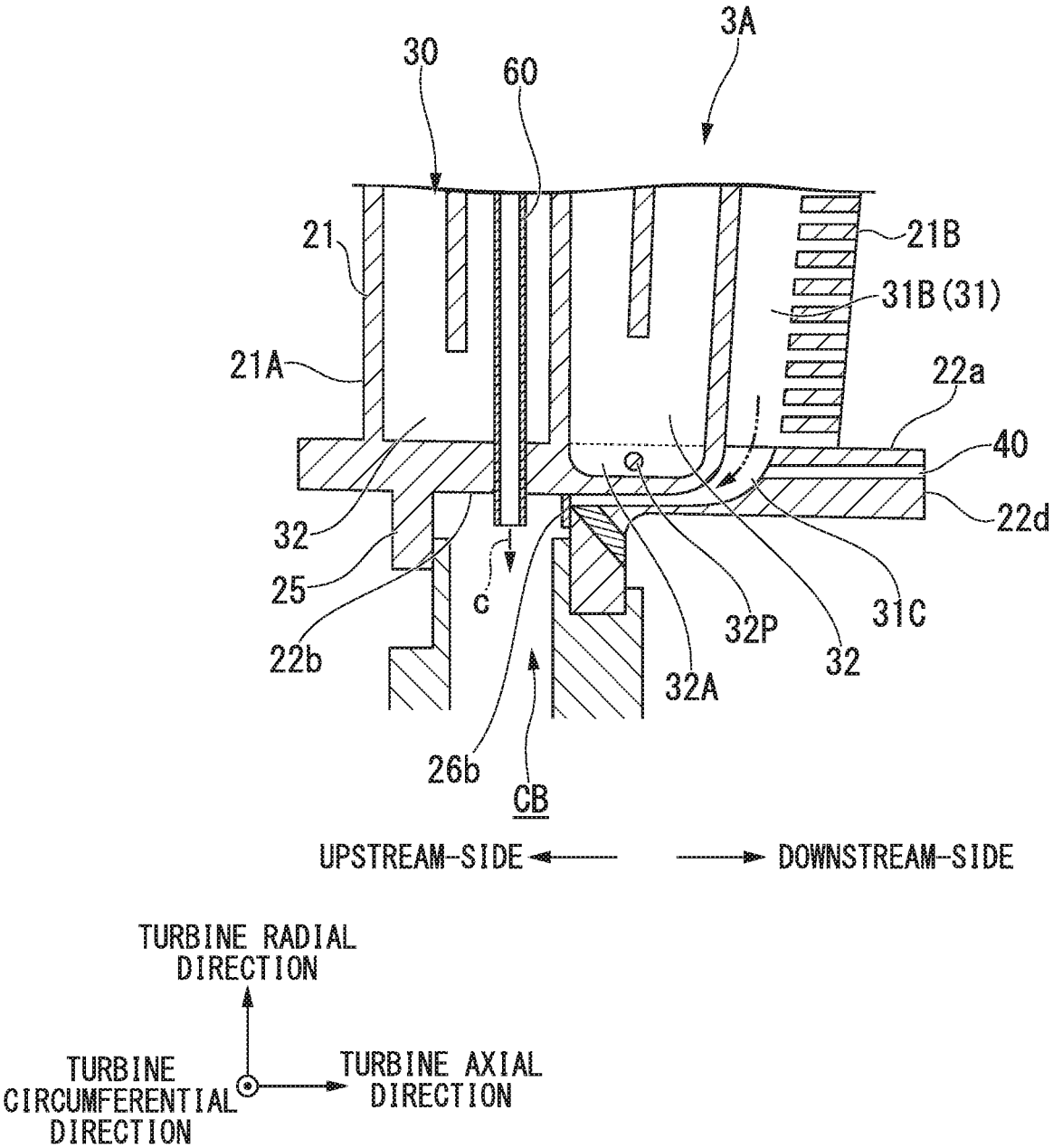
FIG. 12 is a sectional view taken along the line V-V of FIG. 11.
Figure 13:
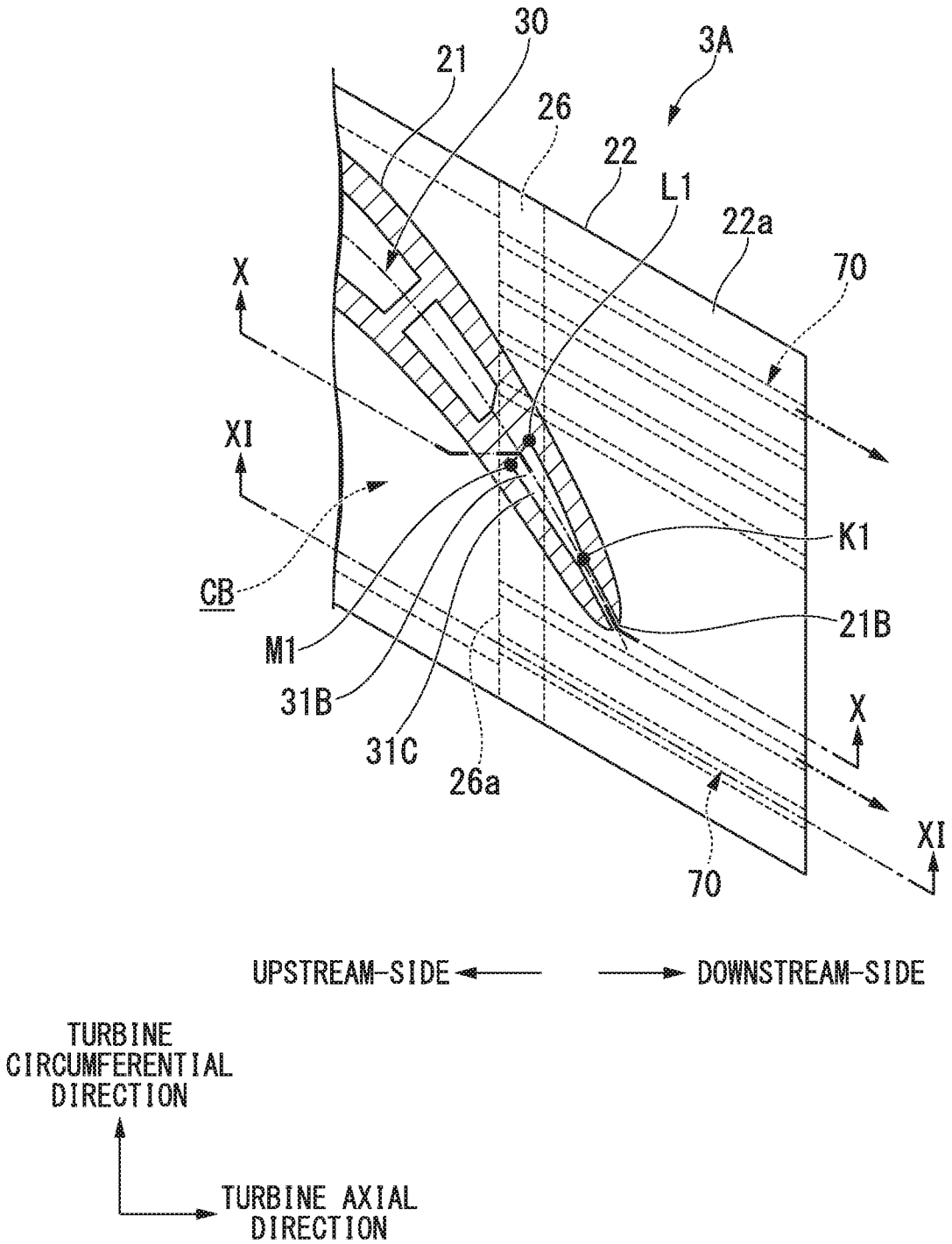
FIG. 13 is a partial plan view showing cooling paths on the trailing edge side of an inner shroud of a conventional turbine vane.
Figure 14:
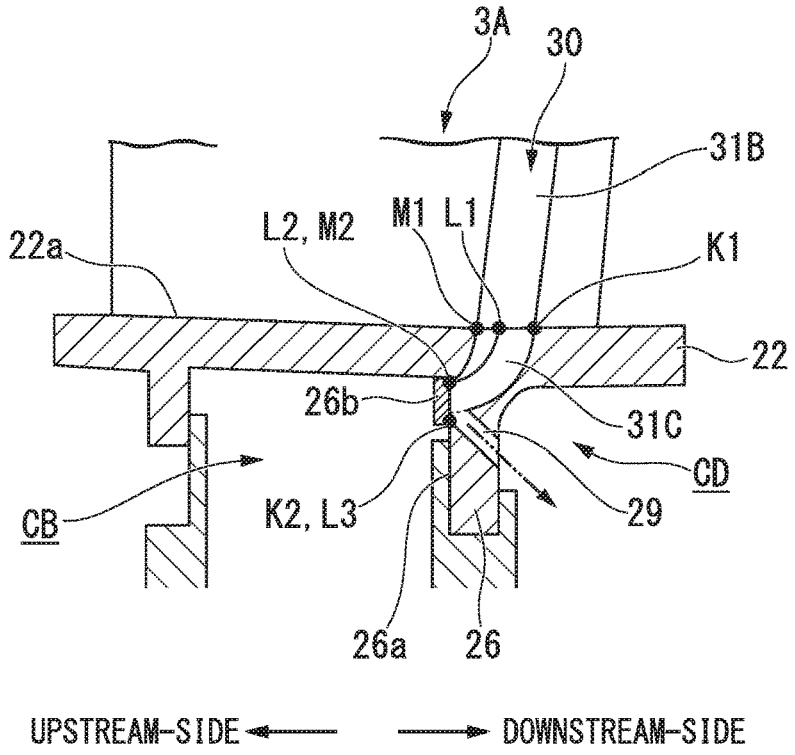
FIG. 14 is a sectional view taken along the line X-X of FIG. 13.
Figure 15:
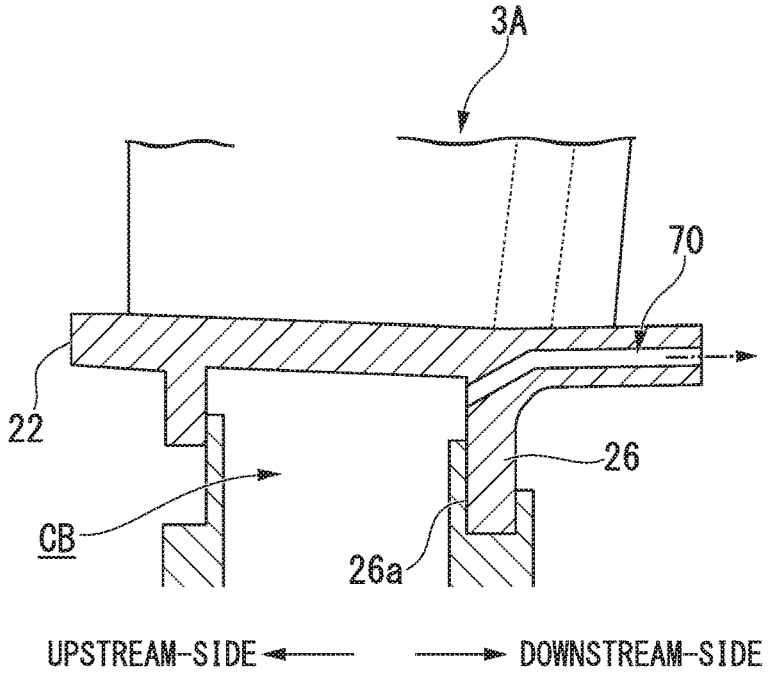
FIG. 15 is a sectional view taken along the line XI-XI of FIG. 13.

As shown in FIG. 12, a recess 32A that is recessed further radially inward from the bottom of the return channel 32 is formed in the return channel 32 constituting a part of the serpentine channel 30 (of the upstream-side channels of the serpentine channel 30 adjacent to the most-downstream main channel 31B, the return channels 32 on the side of the inner shroud 22 are shown in FIG. 12). The opening 32P to which the upstream path 40B is connected is formed in the side wall of the recess 32A on the side of the suction surface 24*a*. Similarly, the opening (not shown) is formed in the side wall of the recess 32A on the side of the pressure surface 24*b*, and the upstream path 40C is connected to this opening.

The return channel 32 including the recess 32A is not necessarily limited to the return channel 32 of the serpentine channel 30 adjacent to the most-downstream main channel 31B, but may instead be the return channel 32 of the most-upstream main channel 31A on the side of the inner shroud 22. It is the same as in the other embodiments and modified examples that the downstream end of the terminal channel 31C is open to the inner cavity CB and that the open end is closed with the cover 26*b*.

According to the turbine vane 3 of this modified example configured as has been described above, effects similar to those of the first embodiment and the second embodiment can be achieved.

According to the turbine vane of this modified example, compared with the second modified example of the second embodiment, the compressed air c at a lower temperature is supplied to the wide cavity 43B and the wide cavity 43C. Thus, even when the temperature distribution increases on the side of the suction surface 24*a* and the side of the pressure surface 24*b* and in the trailing edge part of the inner shroud 22, it is possible to cool the inner shroud 22 over a large area with the lower-temperature compressed air and suppress reduction in thickness due to oxidation of the inner shroud 22.

According to the configurations of the embodiments and the modified examples having been described above, it is possible to reduce the temperature distribution in the circumferential direction in the trailing edge part of the inner shroud 22 and suppress reduction in thickness due to oxidation. As the compressed air c having passed through the serpentine channel 30 and cooled the vane body 21 is used to convectively cool the inner shroud 22, the cooling air is recycled and the thermal efficiency of the gas turbine is enhanced.

While the details of the present invention have been described above, the present invention is not limited to the above embodiments, and various changes can be made to the present invention within the scope of the invention.

For example, in the second embodiment, the first cooling path 40 includes the plurality of branch paths 42, but the first cooling path 40 may instead include only one branch path 42.

In the above embodiments, the second cooling paths 50 are formed in both the inner shroud 22 and the downstream-side rib 26, but the second cooling paths 50 may instead be formed only in the inner shroud 22, for example.

In the above embodiments, the path sealing step is performed to modify the conventional turbine vane 3A, but, for example, the path sealing step may be omitted. In this case, in the modified turbine vane, a part of the compressed air c flowing out from the downstream end of the serpentine channel 30 flows into the first cooling path 40 as in the turbine vane 3 of the above embodiments. A part of the compressed air c having flowed in flows out from the downstream-side end face 22D of the inner shroud 22 into the clearance between the inner shroud 22 and the platform 12. The rest of the compressed air c having flowed out from the downstream end of the serpentine channel 30 flows through the outflow path 29 into the second disc cavity CD as in the case of the turbine vane 3A before modification. The rest of the compressed air c having flowed in flows out into the combustion gas path GP through the clearance between the inner shroud 22 and the platform 12 facing the downstream-side end face 22D of the inner shroud 22. Thus, it is possible to more favorably prevent the combustion gas g passing through the combustion gas path GP from entering the second disc cavity CD.

In the above embodiments, the downstream end of the serpentine channel 30 is located on the side of the inner shroud 22, but the downstream end may instead be located on the side of the outer shroud 23, for example. In this case, for example, the outer shroud 23 may include a first cooling path that has one end open at the downstream end side of the serpentine channel 30 and the other end open at the trailing edge of the outer shroud 23 as with the first cooling path 40 of the inner shroud 22 in the above embodiments. In this configuration, as in the above embodiments, the trailing edge part of the outer shroud 23 can be cooled with the compressed air c flowing out from the serpentine channel 30.

In the case where the outer shroud 23 includes the first cooling path, for example, the outer shroud 23 may include a second cooling path that has one end open to the outer cavity (cavity) CA and the other end open at the trailing edge of the outer shroud 23 as with the second cooling path 50 of the inner shroud 22 in the above embodiments.

INDUSTRIAL APPLICABILITY

According to the above turbine vane, the temperature distribution in the circumferential direction in the trailing edge part of one shroud is evened out, and reduction in thickness due to oxidation of the hot portion of the one shroud is suppressed. Moreover, the cooling medium having passed through the serpentine channel is recycled, and thus the cooling medium can be used effectively. As a result, the amount of cooling air is reduced and the thermal efficiency of the gas turbine is enhanced.

REFERENCE SIGNS LIST

T Turbine
$R_T$ Rotor
1 Turbine casing
2 Turbine blade
3 Turbine vane
21 Vane body
21B Trailing edge end
22 Inner shroud (one shroud)
22*a* First principal surface
22*b* Second principal surface
22D Downstream-side end face (trailing edge)
23 Outer shroud
23*a* First principal surface
23*b* Second principal surface
30 Serpentine channel
31B Most-downstream main channel
31C Terminal channel
40 First cooling path
40A, 40B, 40C Upstream path
41A, 41B, 43A, 43B, 43C Wide cavity
42, 42A, 42B, 44A, 44B, 44C Branch path
50 Second cooling path
CB Inner cavity (cavity)
c Compressed air (cooling medium)

The invention claimed is:

1. A turbine vane comprising:
a vane body extending in the radial direction of a turbine;
a plate-like inner shroud provided at a radially inner end of the vane body; and
a plate-like outer shroud provided at a radially outer end of the vane body, wherein
the vane body includes a serpentine channel which is formed so as to meander inside the vane body in the radial direction and through which a cooling medium flows,
the serpentine channel has a plurality of main channels extending in the radial direction and communicating with each other,
one shroud of the inner shroud and the outer shroud includes:
a terminal channel which has a first end open at a downstream end side of a most-downstream main channel of the plurality of main channels that is disposed farthest on a side of a trailing edge end of the vane body in the serpentine channel;
a first cooling path which has a first end open at the terminal channel and a second end open at a downstream-side end face of a trailing edge of the one shroud and through which the serpentine channel communicates with the outside of the one shroud; and
a second cooling path having a first end and a second end,
the one shroud has a first principal surface on which the vane body is disposed and a second principal surface which is located on an opposite side from the first principal surface,
the second principal surface defines, in part, a cavity,
the first end of the second cooling path opens to the cavity,
the second end of the second cooling path opens at the downstream-side end face of the trailing edge of the one shroud,
the second cooling path is configured to permit a cooling medium in the cavity to pass from the cavity to the downstream-side end face of the trailing edge of the one shroud, and
the second cooling path and the first cooling path are disposed at an interval in the circumferential direction of the turbine.

2. The turbine vane according to claim 1, wherein
a downstream-side end face of the cavity in the axial direction is disposed farther on an upstream side in the axial direction than the most-downstream main channel of the serpentine channel.

3. The turbine vane according to claim 1, wherein the first cooling path is formed along a direction of combustion gas flow and provided within an area, in the circumferential direction of the one shroud, where the most-downstream main channel of the serpentine channel is joined to the one shroud.

4. The turbine vane according to claim 1, wherein the first cooling path is formed along a direction of combustion gas flow and provided so as to include, in the circumferential direction of the one shroud, at least a region where a terminal channel constituting a downstream end of the serpentine channel is disposed.

5. A turbine comprising:
a rotor;
a turbine casing surrounding a periphery of the rotor;
turbine blades fixed to an outer circumference of the rotor; and
turbine vanes, according to claim 1, that are fixed to an inner circumference of the turbine casing and arrayed alternately with the turbine blades in the axial direction of the rotor.

6. The turbine vane according to claim 1, wherein the one shroud is the inner shroud,
the inner shroud further includes a rib,
the rib protrudes radially inward from the second principal surface, and
the terminal channel extends from an area of the first principal surface located at a downstream end of the serpentine channel inside the rib located radially inward with respect to the second principal surface, and an end of the terminal channel is closed.

* * * * *